US006142474A

United States Patent [19]

Tachkov et al.

[11] Patent Number: 6,142,474

[45] Date of Patent: Nov. 7, 2000

[54] TWO, THREE OR FOUR PARTICIPANT/ FOUR ARMY CHESS-LIKE GAME

[76] Inventors: Ilian J. Tachkov, 2439 W. Lunt Ave., Chicago, Ill. 60645; Helen J. Tachkov, 1245 W. Altgeld, Chicago, Ill. 60614; Spaska S. Tachkov, 2439 W. Lunt Ave., Chicago, Ill. 60645

[21] Appl. No.: 09/134,847

[22] Filed: Aug. 14, 1998

[51] Int. Cl.[7] ..... A63F 3/02

[52] U.S. Cl. ..... 273/260; 273/261; 273/262

[58] Field of Search ..... 273/260, 287, 273/261, 241

[56] References Cited

U.S. PATENT DOCUMENTS

| | | |
|---|---|---|
| 3,829,099 | 8/1974 | Lucer . |
| 4,093,237 | 6/1978 | Weiss . |
| 4,856,789 | 8/1989 | Carlson . |
| 4,940,241 | 7/1990 | Faraci . |
| 5,257,787 | 11/1993 | Miccio . |
| 5,351,965 | 10/1994 | Telfer . |
| 5,511,793 | 4/1996 | Watt . |
| 5,570,887 | 11/1996 | Christie . |
| 5,662,329 | 9/1997 | Nason . |
| 5,749,583 | 5/1998 | Sadounichvili . |

*Primary Examiner*—Jeanette Chapman
*Assistant Examiner*—V K Mendiratta
*Attorney, Agent, or Firm*—Adrienne B. Naumann

[57] ABSTRACT

A modified game of chess comprising four individual armies is disclosed herein. There can be two, three, or four individual participants. A gameboard is modified to comprise seventy-two alternating smaller squares of equal dimensions for a total of 144 squares, but of two distinct alternating colors. The gameboard has a border with linear groups of designation marks for initial pawn movements. The methodology is novel in that two, three, or four participants, each initially with his or her own modified army of chess pieces, can form or dissolve alliances with other armies. Armies may also, by checkmate, control one or more defeated armies. The result is a modified game for experienced players.

5 Claims, 36 Drawing Sheets

TWO, THREE OR FOUR PARTICIPANT/ FOUR ARMY CHESS-LIKE GAME

BACKGROUND OF THE INVENTION

Our invention relates to an article of manufacture which functions as a modified chess gameboard with associated chess pieces. More particularly, our invention relates to improvements to a chess-like game for two, three or four individuals. There are four separate full armies with no less than two but not more than four individuals playing chess simultaneously against each other.

The conventional chess game requires two chess players, each player being in control of one separate army. The term 'army' is well known in the art among those skilled in the game of chess. The conventional game is played on a square gameboard which is divided into thirty two light and thirty-two dark squares. These squares are all of equal size and arranged to alternate in a checkered pattern. Thirty two chess pieces are separated into two equal army sets by color, conventionally, black and white. The game is played in accordance with the well known conventional rules.

Others have modified the above conventional game to accommodate more players or simplify the rules. U.S. Pat. No. 4,940,241 (Faraci, Jr.) comprises a three player chess-like game with a gameboard shaped as an equilateral triangle.

U.S. Pat. No. 5,257,787 (Miccio) describes a chess-like game which comprises a lesser number of vertical and horizonal rows on the gameboard. Miccio also has a reduced number of playing pieces.

U.S. Pat. No. 3,829,099 (Lucero) discloses a gameboard for a game of chess with four players. There is a conventional gameboard and each player controls one-half of an army.

Our invention is superior in that the experienced player will find our four complete set approach more challenging and intricate. Accordingly, one object of our present invention is to raise the technical and intellectual requirements above that of conventional two player/two army chess. In the preferred approach, one player pits himself or herself simultaneously against three individual opponents, each with a full army. An individual player wins by checkmating the Kings of the other three armies.

The preferred embodiment of our invention comprises a square game board. This gameboard, in turn, comprises equal numbers of smaller seventy-two dark and seventy-two light equal sized squares. These squares alternate in a checkered light and dark pattern, which in the preferred embodiment are black and white.

The gameboard also comprises a complete border surrounding the entire periphery of the checkered area. The border, in turn, comprises designation marks which dictate forward movements of pawns, a playing piece well known in the art of playing conventional chess.

The physical embodiments of gamepieces of our invention are similar to those of conventional chess, with the exception of minor physical modifications to the pawns. These gamepieces generally move similarly to those of conventional two player and two army chess. However, the number and movements of several gamepieces differ from conventional chess, see infra. Pawns in our improved game move forward on the modified gameboard in two different forward directions.

BRIEF SUMMARY OF THE INVENTION

Our invention comprises a game performed with moveable chess-like pieces on a flat gameboard. More particularly, our invention comprises a modified chesslike game for two, three, or four independent participants. Each army of gamepieces, as in conventional chess, has its own chronological opportunity to move along the gameboard. Our present invention elevates the requirements for participant expertise above that of conventional two participant/two army chess. See FIG. 3.

In addition to the preferred embodiment described herein, two participants can play our invention using modified methodology: Each participant controls two (2) separate opposing armies along the diagonal axis of the gameboard. See FIG. 3.

With three participants, one participant controls two separate opponent armies along the diagonal axis of the gameboard. This last approach initially appears inequitable, because (i) one of three participants controls two opponent armies and (ii) the other two participants control only one opponent army each. However, this is not necessarily the case: the single participant controlling two armies are opposed by the other two participants (which control two armies altogether).

See FIG. 4. Once again, in this variation from the preferred embodiment, each army has its own chronological opportunity to move along the gameboard. Each army can be opposed by another army under certain conditions, which are described in detail below.

Our preferred embodiment is directed to a chesslike game for four individual participants in the preferred embodiment. Our invention comprises our novel modified army components, methodology and gameboard. In the most modest approach, each participant simultaneously challenges the others by moving his or her own separate full army. In the preferred embodiment, each participant initially begins simultaneously against three individual opponents. See FIG. 5. A participant ultimately prevails by capturing and removing from the game, e.g., checkmating the kings of all three opponents.

Our modified chess-like game is comprised of a square game board composed of one hundred and forty-four smaller squares, of equal number, of a dark and a light color. These squares, smaller in dimension than the gameboard, and all of the same dimension, alternate in a checkered pattern. In the preferred embodiment the two colors of the two series of smaller squares are black and white.

Along the border of the gameboard there are designation marks relating to pawns, a gamepiece well known among chess enthusiasts. There are sixty-four conventional and modified gamepieces, which are divided into four separate armies. Each army comprises gamepieces of the same color, but which are unique from the other armies. These colors of gamepieces of each army in the preferred embodiment are red, black, white and yellow. However, one can use other colors or designs.

Our invention differs in part from conventional chess because: (i) the number of gamepieces in each of the four armies differs from conventional chess; and (ii) pawns in our modified invention are of three physical variations and move forward in two different directions.

Our invention comprises a modified methodology with respect to rules by which our invention is played. These rules give participants the option to form an "alliance" between originally opposing armies. No more than two participants can temporarily and consensually join two (2) armies to initiate or repel attacks. On the other hand, 'dissolution' of an alliance provides protection for other participants. It also ensures that a single participant will ultimately prevail because allied armies revert to status as opposing armies.

Our novel rules also allow a King, a gamepiece well known in the art, to have certain logistical advantages under special conditions in our invention. For example, a King can move into checked positions to escape "checkmate" or to capture an opposing gamepiece.

Our invention's methodology also allows participants to overtake entire opposing armies and create what is known as a 'great army.' With a 'great army' a participant uses a defeated army, in addition to his original army, against the remaining opposing participants.

It is therefore an object of our invention to create a modified chess-like game which comprises four full armies and in which there may be two, three or four participants.

It is also an object of our invention to create a modified gameboard on which there are designation marks indicating forward pawn movement and direction.

It is also an object of our invention to create a gameboard comprising small squares,a border along the entire perimeter of the gameboard and designation markers further comprising that border.

It is a further object of our invention to create a methodology in which an army can consensually form an alliance with another participant's army.

It is a further object of our invention to provide for dissolution of an alliance.

It is a further object of our invention to allow a King to move into a check position for strategic purposes.

It is a further object of our invention to create a methodology by which a participant may control an opponent's army and use it, in addition to his or her original army, against the remaining participants.

It is yet another object of our invention to create a more intricate methodology of playing chess so that the modified game is more intellectually challenging.

These and still other objects and advantages of our invention will become apparent from the following description of the preferred embodiment of our present invention, as well as other embodiments.

BRIEF DESCRIPTION OF THE DRAWINGS

FIG. 21 also illustrates the chronological turn and move of Red Central division of a Great Army.

DETAILED DESCRIPTION OF THE INVENTION

Figure 1:
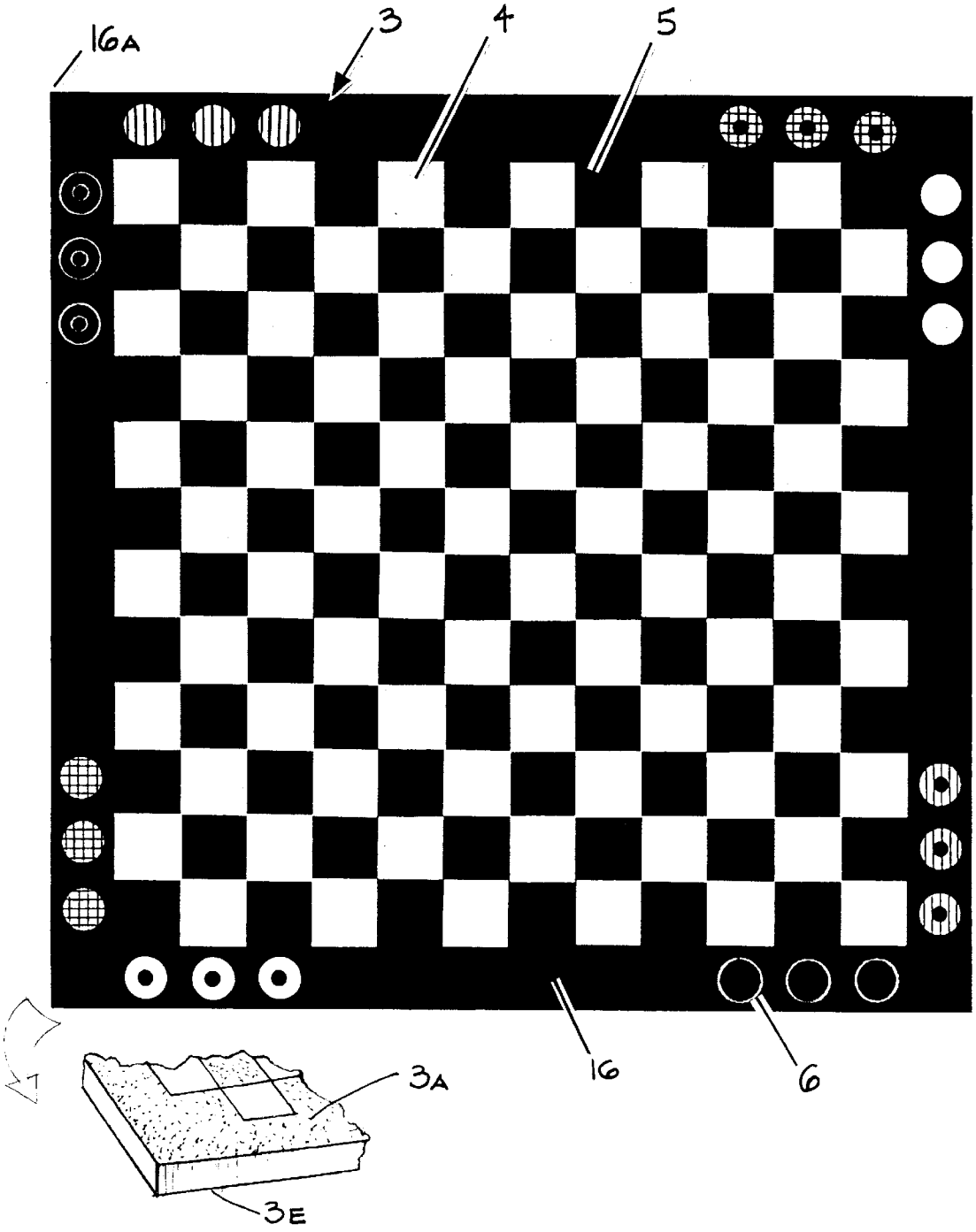
FIG. 1 is a plan view of the modified chess gameboard.

The present invention, hereinafter referred to as the two, three, or four participant/four army modified game of conventional chess 1, is a gameboard 3 and gamepieces 22 of manufacture 2 (gameboard 3 and game pieces 22) in combination with a novel methodology 2*a*. As seen in FIG. 1, in the preferred embodiment flat gameboard 3 is square in shape, with a top and bottom surface. As is conventional chess, our modified game of conventional chess is played on the top surface. In the preferred embodiment, gameboard 3 dimensions are approximately 20 (twenty) inches per side, but our invention's scope includes other square or rectangular gameboards 3 of varying dimensions.

In the preferred embodiment, upon gameboard 3 there are seventy-two light squares 4 and seventy-two dark squares 5, which alternate in a checkered pattern on top surface 3*a* of gameboard 3. The dimensions of squares 4,5 are generally one and one-half (1 and ½) inches per side. However, our invention's scope includes squares 4,5 of different dimensions. The bottom surface of gameboard 3 is designated 3*e*.

In the preferred embodiment alternating squares 4 and 5 are white and black respectively, but could be any two distinctly different colors or patterns.

Figure 2:
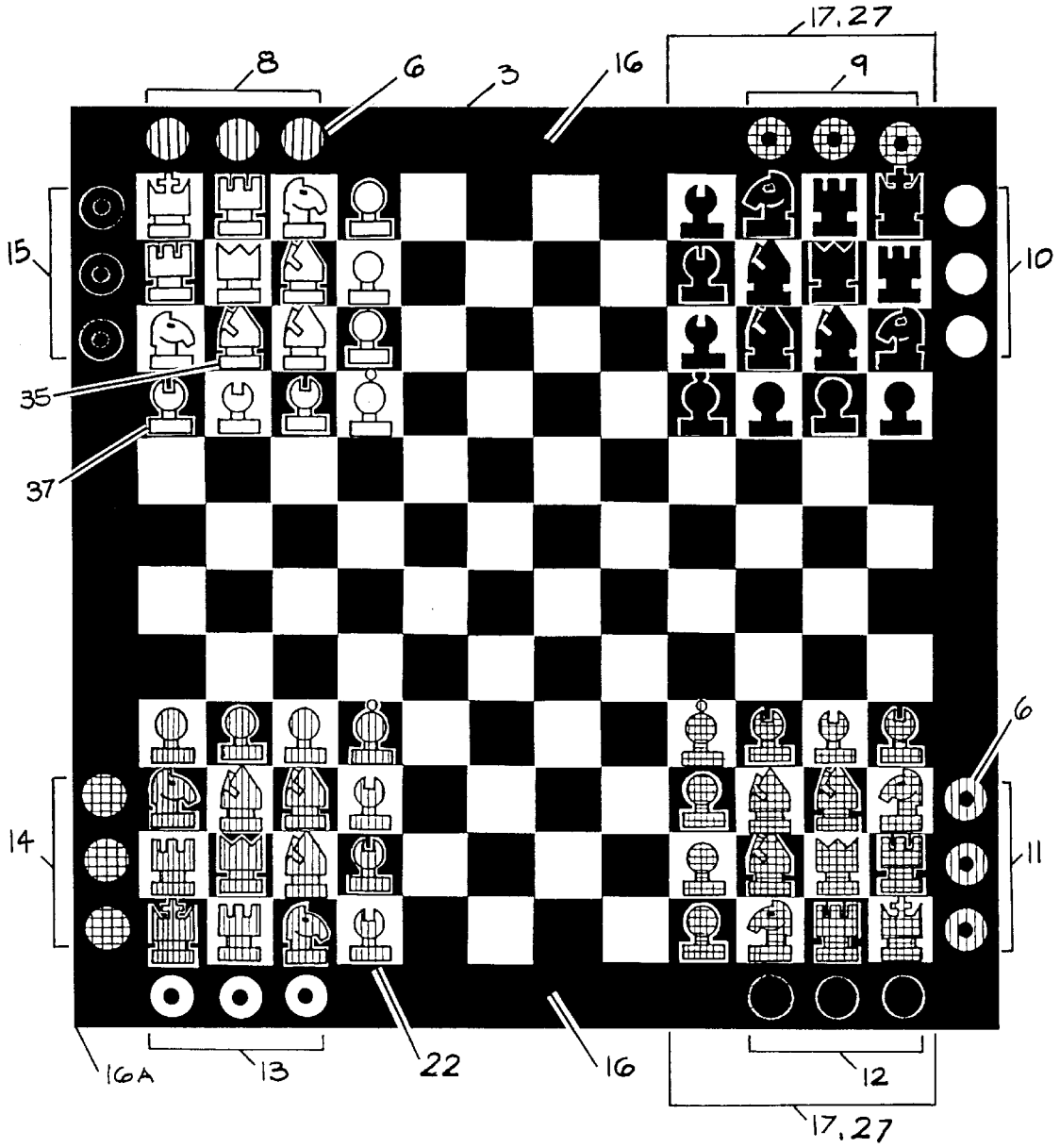
FIG. 2 is a view of the modified flat gameboard illustrating the initial position of each of four armies.

Referring to FIG. 2, in the preferred embodiment, shapes hereafter referred to as designation marks 6, are located along a border 16 completely surrounding the portion of the gameboard 3 comprising a checkered pattern on the top surface. Marks 6 are located on gameboard border 16.

Designation marks 6 are divided into eight specific linear groups in FIGS. 2: 8,9,10,11,12,13,14,15. Marks 6 are in sets of three in the preferred embodiment. Each set of marks 6 is arranged linearly along border 16 of gameboard 3. Each group of marks 6 is also linearly adjacent to each right angle 16*a* comprising configuration of gameboard 3.

As seen in FIG. 2, in the preferred embodiment each designation mark 6 is round and comprises the same color or design as its two linearly positioned counterparts. However, the scope of our invention includes designation marks 6 which can be of different two dimensional or even three-dimensional shapes. There can also be any appropriate design or color within each group of three marks 6, as long as it is used for each mark within a linear group, or set as the case may be.

FIG. 2 also illustrates the initial positions of each of the four armies 17 in the preferred embodiment. Each army has sixteen gamepieces 22, which are, in large part, of the conventional chess variety.

However, the scope of our invention 1 includes other shapes and sizes, as long as pieces 22 perform adequately with our novel game methodology 2*a*.

For clarity two separate sections are provided below. Section I briefly describes the gameboard, methodology and game pieces common to conventional chess and our invention 1. Section II identifies game pieces, gameboard and methodology novel to our invention 1.

Section I

Rules Common to Both Conventional Chess and Our Invention 1

1. Pieces are arranged in armies of equal number and strength by color. Game participants alternate moves in conventional chess and our invention. In conventional chess each army is composed of sixteen pieces: a king, a queen, two bishops, two rooks, two knights and eight pawns which move forward in the same direction.

The forward direction of pawns in conventional chess is based on (i) the initial arrangement of the pieces for each army and; (ii) on the fact that there are only two armies in the game. All pawns in each army move forward against one opponent positioned along the vertical axis directly opposite therefrom.

2. In conventional chess, a participant cannot make two consecutive moves upon the board with gamepieces of the same color. A participant cannot place two game pieces in the same square at the same time.

3. When a participant captures an opponent's piece, he or she must remove the captured gamepiece from the square which it previously occupied. Participant must then place his/her own gamepiece 22 in that square.

4. The rules for a "Draw Game," (e.g., when one participant (i) cannot checkmate another participant's King; (ii) when participants agree to end the game; or (iii) there is a stalemate when the King is not in check but his only moves put him into checkmate), remain exactly the same as those for conventional chess.

5. Castling, e.g., when two pieces 22 are moved simultaneously, in conventional chess, has a similar counterpart in our invention 1, see detailed discussion infra.

In conventional chess "castling" is between a King and a Rook. This is the only opportunity for a King to move more than one square 4 or 5 during one turn. Moreover, a participant can castle only once in any game.

In our invention 1 castling occurs between a King 30 and a Bishop 34. This is explained in more detail in Section II below.

6. The rule for "in passing" in our invention, applies when one participant moves a pawn two squares forward to avoid capture by an opponent's pawn. This methodology is exactly the same as in the conventional chess game.

7. The rules governing "Check", e.g., when a King is attacked by any opponent piece, are similar for conventional chess and our invention 1. However, our invention's novel methodology allows a King 30, to move into a checked position with no immediate adverse consequences. See discussion infra, Section II.

8. The rule governing 'notification of check', e.g., when the king is placed in check by an opponent and must be warned, is the same for our invention as for conventional chess. However, there are notable exceptions discussed in Section II, infra.

The goal of conventional chess participants is to defeat an opponent's army by placing the opponent's King in check from which the checked King cannot escape. Conventional chess defines this maneuver as "checkmate." Under this condition the conventional chess game ends. However, our invention 1 comprises methodology modifications to the concept of conventional checkmate to accommodate four armies 17 each with one King 30.

In our invention, checkmate is defined as the "capture," ie., physical removal from gameboard 3 of a King 30. In our invention, checkmate requires two separate steps:

(1) the conventional step of checkmate which is check from which the checked King cannot escape; (2) physical removal of the checked King 30 from gameboard during a subsequent chronological turn of the capturing opponent. The difference,therefore, in our invention is that it takes two chronological turns to permanently defeat an opponent's army by physically eliminating the opponent's King 30 from gameboard 3.

The Gamepieces and How They Move In Conventional Chess

1. The King is the most important gamepiece in conventional chess and our invention 1. When a participant captures an opposing King, the entire army associated with that opposing King is defeated.

The King moves and captures any opposing gamepieces, except another participant's King, along the gameboard one square of either light or dark color at a time. A participant's King may move vertically, horizontally or diagonally in conventional chess.

In conventional chess the King cannot move into a position "checked" by an opponent gamepiece. This rule is modified in our methodology 2, infra.

2. The Queen captures opposing pieces by moving vertically, horizontally, or diagonally along the gameboard. A Queen can move as many squares as possible if she is unobstructed by other gamepieces. The Queen moves only in one direction per chronological turn. If Queen meets any opposing gamepiece, she must stop or capture it.

3. The Rook moves in vertical or horizontal directions only on the gameboard. A Rook can move as many squares as there are vacant, but only in one direction at a time. If a Rook meets an opposing piece, it must stop or capture it.

4. A Bishop moves and captures opposing pieces in a diagonal direction only. It may proceed any distance during one chronological turn, as long as no other gamepiece obstructs its way.

5. The Knight is the only gamepiece in conventional chess and our invention which can move and capture by jumping over other gamepieces. It moves two squares forward, and one square to the side at a ninety degree angle to the right or left. A Knight can also move one square forward, and two squares to the side at a ninety degree angle to the right or left.

6. In conventional chess a Pawn moves from its initial starting position by moving directly forward either one or two squares. Thereafter, this Pawn moves only one square at a time and only in a forward direction along the gameboard.

A Pawn captures an opposing gamepiece by moving forward diagonally one square at a time in the conventional game. If a Pawn advances to the opposite end of the gameboard from its initial position, it is exchanged for a Queen or any other gamepiece except a King. This is known as "queening a pawn." As a result, an army can have more than one Queen.

Section II

Novel Methodology, Gamepieces and Gameboard

Figure 3:
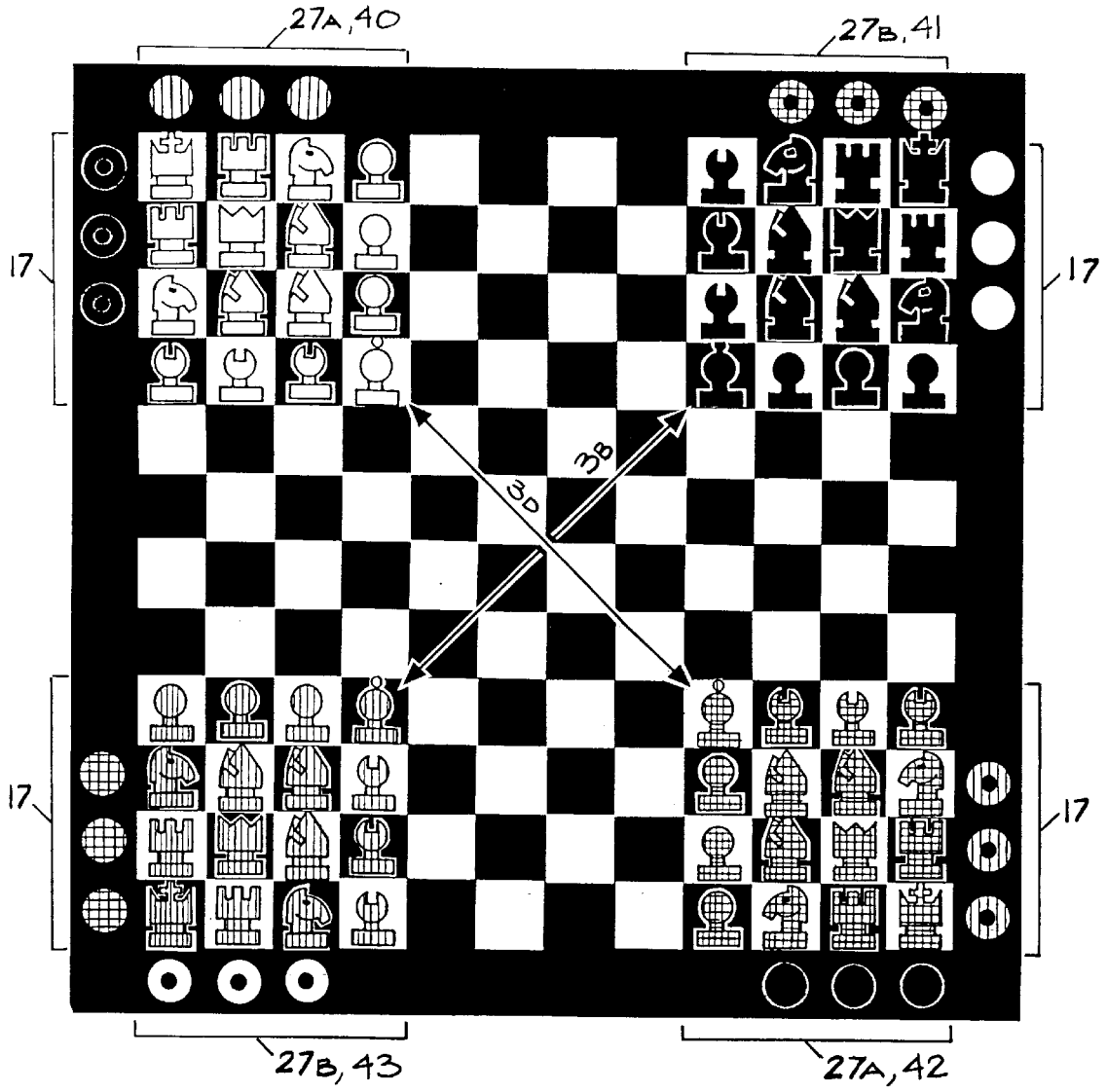
FIG. 3 is a view of the modified flat gameboard illustrating the initial position of each of the four armies for each of two participants.

As illustrated in FIG. 2, in the preferred embodiment each of four participants 27 initially control one army 17. Within an army 17, gamepieces 22 are all of one color. However, our invention 1 a modified game of conventional chess also comprises a modified chesslike game with four armies 17 but only two or three participants 27. As seen in FIG. 3, in a second embodiment two participants 27*a*, 27*b* can play simultaneously, each with two separate opponent armies 17, along the diagonal axis 3*d* and 3*b* of gameboard 3. Each army 17 has a chronological opportunity or turn, to move along gameboard 3.

Referring to FIGS. 1, gameboard 3 is a square flat article of manufacture with an upper surface 3*a* and a lower surface 3*e*. It comprises seventy-two dark and seventy-two light smaller, but equal sized squares which alternate in a checkered pattern. In the preferred embodiment, along perimeter border 16 at the four corners 16*a* of gameboard 3, there are circular designation marks 6.

Gameboard 3 is made of plastic in the preferred embodiment. However, gameboard 3 can also be made of different grades of plywood, cardboard, ceramic, or other suitable sheetlike materials, within the scope of our invention.

As seen in FIG. 2, each army 17 is composed of sixteen gamepieces 22. Our invention 1 differs from conventional chess in that each army 17 contains three Bishops 35 instead of two. Also, there are initially seven Pawns 37 per army 17, instead of eight as in conventional chess.

The number of gamepieces 22 in army 17 are as follows in our invention 1 of a modified conventional chess game: one King 30, one Queen 33, two Rooks 35, two Knights 36, three Bishops 34 and seven Pawns 37. Our invention's seven Pawns 37 are further sub-divided into three groups, two of which, Pawns 37*a* and 37*c*, are physically different in appearance from conventional chess pawns.

Figure 5:
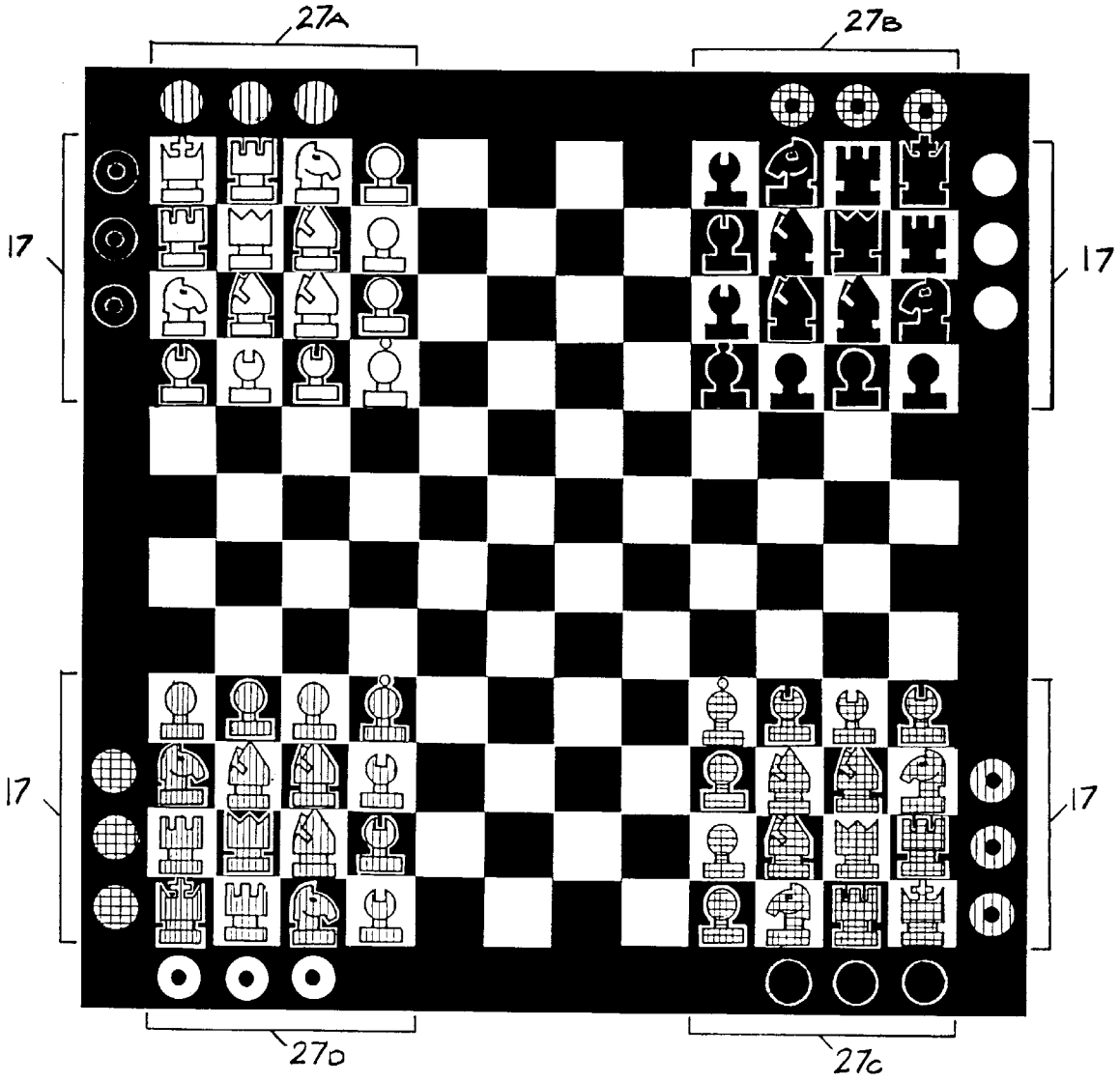
FIG. 5 is a view of the modified gameboard illustrating the initial position of each of four armies for each of four participants.

As seen in FIG. 5 our invention 1 requires four individual participants 27*a*,27*b*,27*c*,27*d* in the preferred embodiment. In the preferred embodiment, each participant 27*a*,2*b*,27*c*, 27*d* plays against the opposing participants, each initially with a single army 17.

In the preferred embodiment, the color of the gamepieces 22 of each of the four armies 17 are: White 40, Black 41, Yellow 42 and Red 43. However, other armies 17 comprising gamepieces 22 of other colors are also within the scope of our invention, if each color is consistent within a single army 17.

Another crucial distinguishing feature for the preferred embodiment is the number of initial participants 27. In the preferred embodiment there are four initial participants 27. Each participant in the preferred embodiment initially controls a single opponent army 17 with a chronological opportunity to move a gamepiece 22 along gameboard 3.

As seen in FIG. 3, in a two player scenario, each of two participants 27*a*, 27*b* controls two separate opponent armies 17 along diagonal axis 3*d* or 3*b*. Each of two armies 17 controlled by one participant 27 has its own chronological opportunity to move along the gameboard 3 independently of the other. In other words, in two participant/four army chess, each participant 27 has two separate and distinct chronological turns to move gamepieces 22 from his or her first or second army 17.

As seen in FIG. 5, in our preferred embodiment each of participants 27*a*,27*b*,27*c*,27*d* initially controls one opponent army 17. In our two participant embodiment, e.g., each participant 27*a*,27*b* controls two opponent armies 17. Please see FIG. 3.

Referring again to FIG. 3, one possible chronological order of moving (e.g., "taking turns") is: White Army 40, Black Army 41, Yellow Army 42 and Red Army 43 (generically all are armies 17). First participant 27*a* has the first opportunity to move a White gamepiece 22 along gameboard 3. Second participant 27*b* next has the opportunity to move the Black gamepiece 22 along gameboard 3. Subsequently first participant 27*a* can move Yellow gamepiece 22 along gameboard 3. Finally, second participant 27*b* can now move his Red Army gamepiece 22 along gameboard 3.

Figure 4:
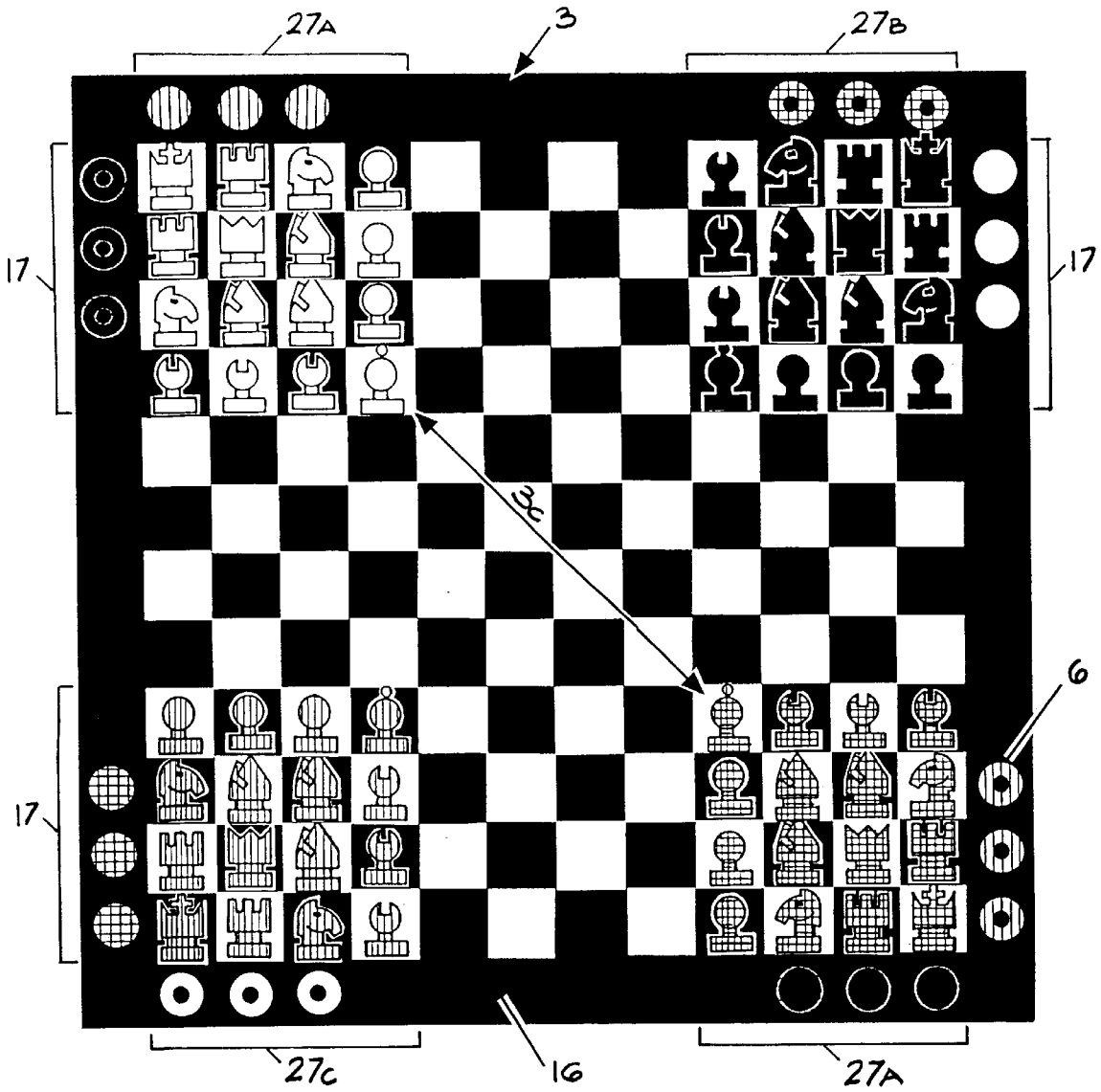
FIG. 4 is a view of the modified gameboard illustrating the initial position of each of four armies for each of three participants.

As seen in FIG. 4, there is a third embodiment of our invention with three initial participants 27*a*, 27*b*, 27*c*. One of three participants controls two opposing armies 17. The two armies 17 controlled by participant 27*a* are also simultaneously opposing armies 17 as between themselves. Participant 27*a* must take this into consideration to prevail. The two remaining participants 27*c*, 27*b* each control a single army 17.

As illustrated in FIG. 4, participant 27*a* has the opportunity to move his first gamepiece 22 of White Army 17 along gameboard 3. Second participant 27*b* next has the opportunity to move Black Army gamepiece 22, along gameboard 3. Subsequently first participant 27*a* can move Yellow gamepiece 22 along gameboard 3. Finally, third participant 27*c* can move Red gamepiece 22 along gameboard 3.

In sum, three participants 27*a*,27*b*,27*c* can also play simultaneously against each other when one of the three participants begins with two separate opponent armies 17 along diagonal axis 3*c*. Each army 17 has its own chronological opportunity to move along gameboard 3. See FIG. 4.

It appears that participant 27*a*, who initially controls two armies 17, has an unfair advantage. However, participant 27*a* with two armies 17 plays initially with such armies in opposition to each other as well as other opposing armies 17. Moreover, gamepieces 22 of each army 17 are opposed by remaining armies 17.

Game Pieces 22

Figure 7:
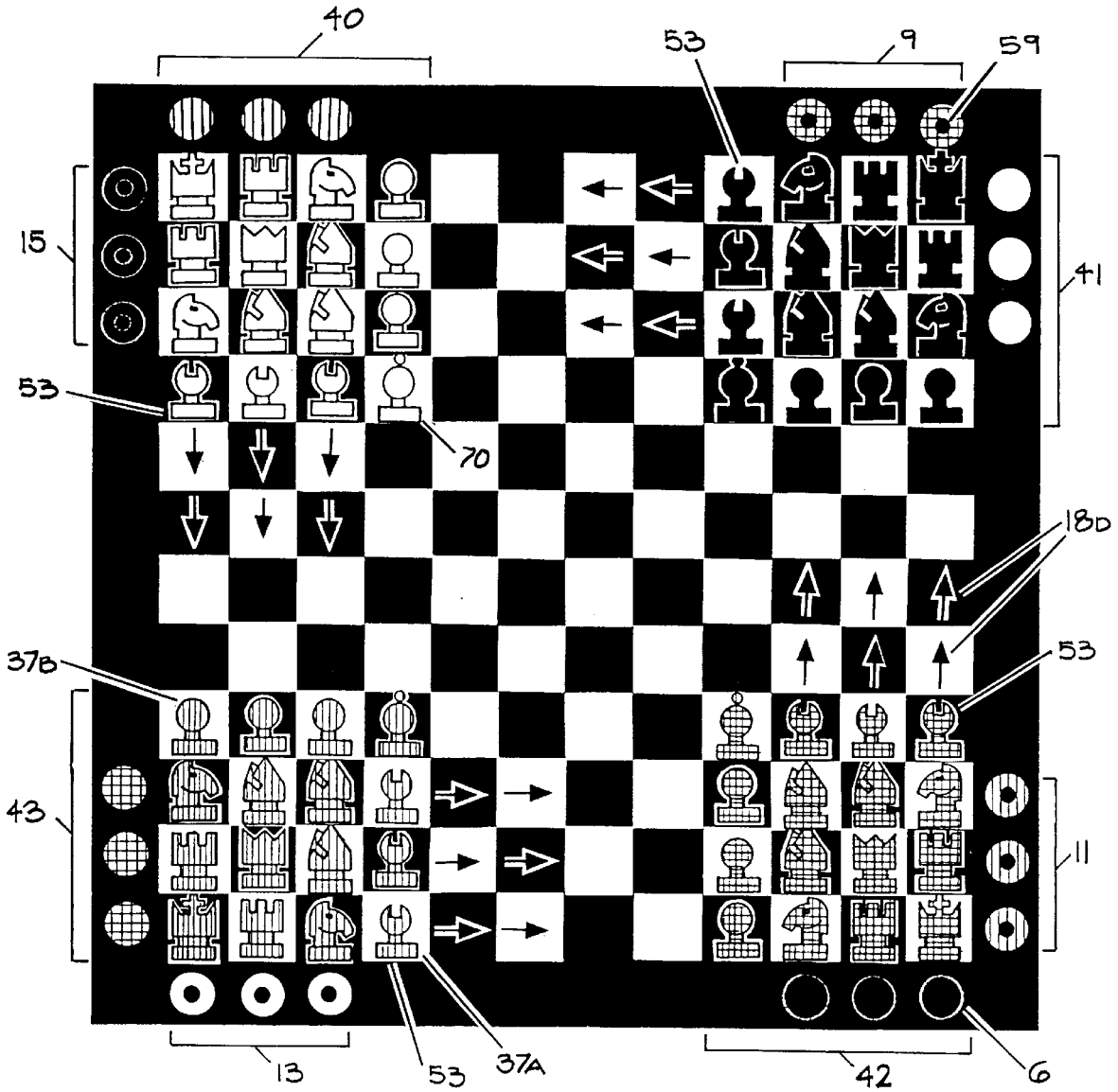
FIG. 7 illustrates a typical initial forward movement of the pawns of the Holy Wing.

As seen in FIG. 7, our preferred embodiment invention 1 comprises gamepieces 22 arranged as four generic individual armies 17 by color: White 40, Black 41, Yellow 42 and Red 43. However, other colors and designs for gamepieces 22 are also within the scope of our invention.

Colors of the preferred embodiment comprise black and white coding by hatching or other means as suggested by the PTO publication "A Guide to Filing a Patent Application (draft), September 1996, page 19, and which is incorporated by reference. This means that on every figure herein, black represents black gamepieces 22, white indicates white gamepieces 22, vertical lines signify red pieces 22 and intersecting hatching at 90 degree angles signify yellow gamepieces 22.

Figure 6:
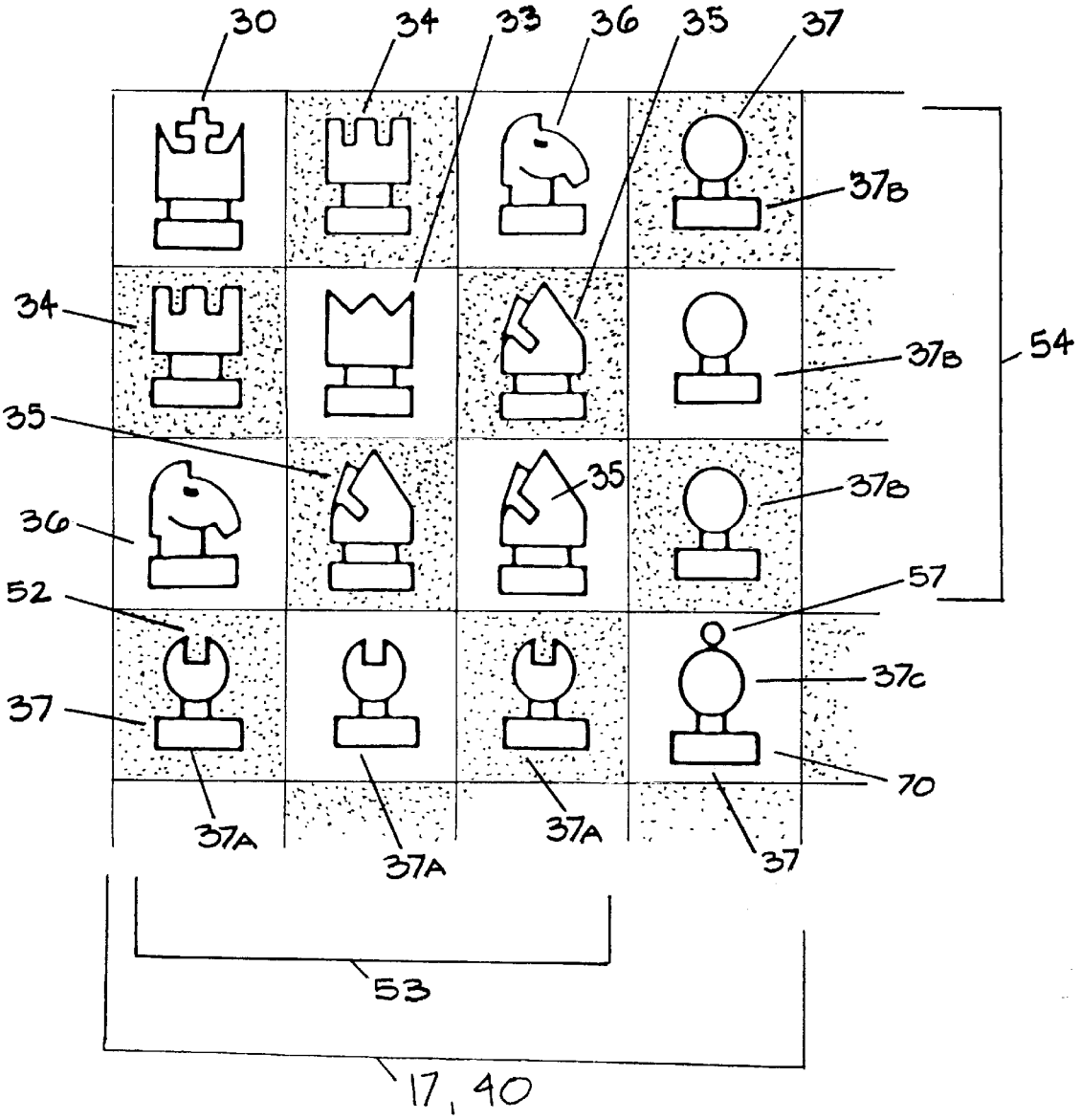
FIG. 6 is an enlarged detailed view of the arrangement of the white army, identifying pieces common to each of the remaining 3 armies.

As seen in FIG. 6, also within the scope of our invention are different shapes and sizes of gamepieces 22. In the preferred embodiment, however, three Pawns 37*a* of each army 17 have upper apertures 52, while one Pawn 37*c* in each army 17 has a small spherical protuberance 57.

Referring again to FIG. 6, in the preferred embodiment, each army 17 initially comprises one King 30, one Queen 33, two Rooks 34, three Bishops 35, two Knights 36, and seven Pawns 37. The seven Pawns 37 initially comprising each army 17 are divided into three groups herein for clearer identification.

Referring again to FIG. 6, Holy Wing 53 is one of two initial linear arrangements of Pawns 37. Holy Wing 53 is comprised of three identical Pawns 37*a* (see FIG. 6) and located directly opposite opponent army 17.

FIG. 7 illustrates arrows 18*d* on squares 4 or 5 indicating initial movement and forward direction of Pawns 37*a* of Holy Wing 53. Pawns 37*a* each have a small upper aperture.

Figure 8:
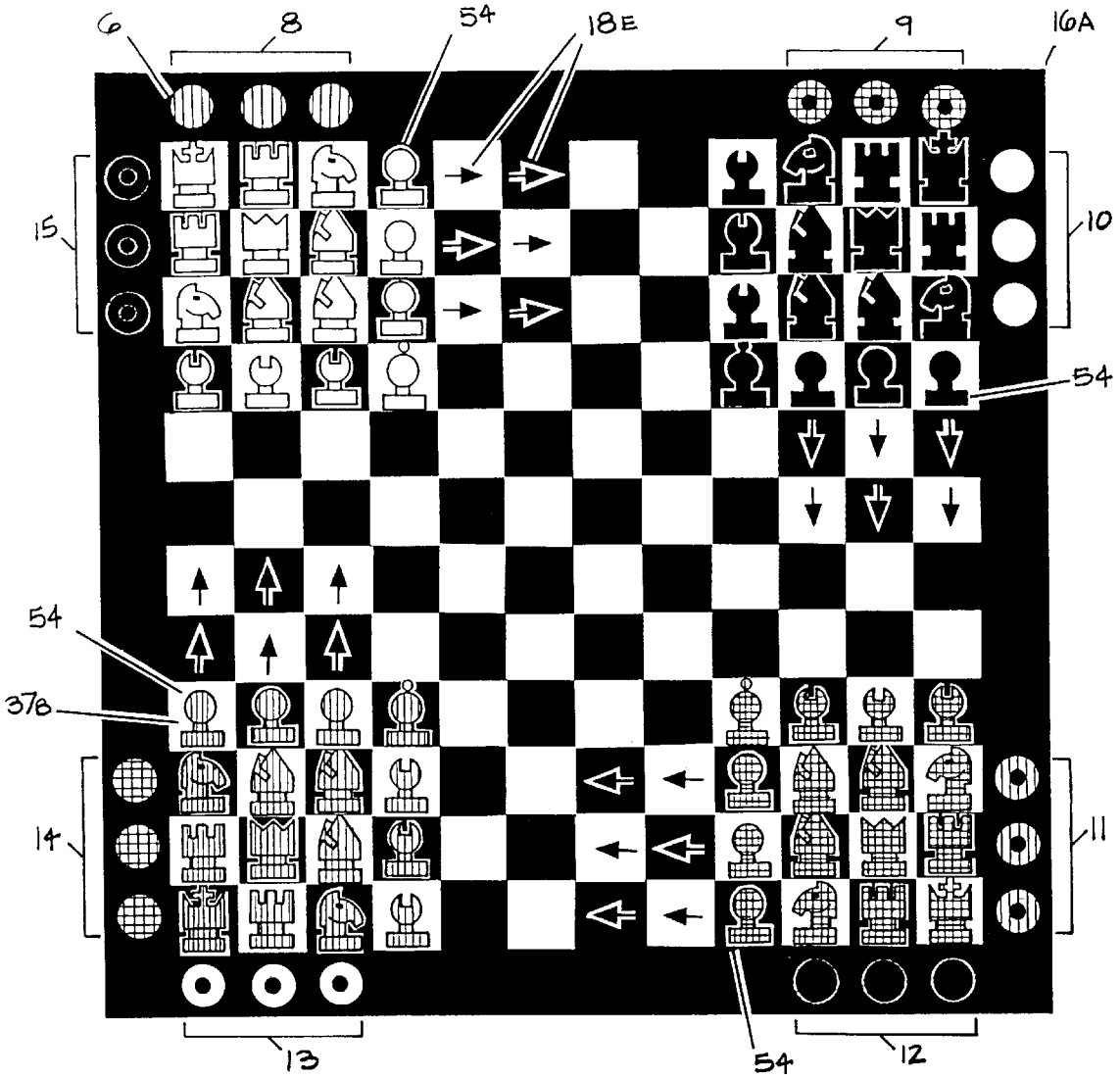
FIG. 8 illustrates a typical initial forward movement of the Head Wing Pawns.

Head Wing 54 is the second of two initial linear arrangements of three identically structured Pawns 37*b*. Please see FIG. 6. Pawns 37*b* are located directly opposite an opponent army 17. Referring to FIG. 8, in the preferred embodiment three Pawns 37*b* form Head Wing 54 of each army 17, but have no apertures 52.

Referring to FIG. 8, Pawns 37*b* move toward designation marks 6. Marks 6 comprise circles 8,10,12,14,which match the color of the opposite located Pawns 37 in the preferred embodiment.

Again referring to FIG. 8, arrows 18*e* on squares 4 or 5 indicate the movement and forward direction of Pawns 37*b* of Head Wing 54 toward the appropriate designation marks 6.

Referring again to FIG. 6, there is a single Pawn 37*c* with a spherical upper protuberance 57. Pawn 37*c* is initially located at the intersection square 70 of Army Wings 53,54 as seen in FIGS. 6,7, and 8.

In the preferred embodiment, each three member set of designation marks 6 match the color or design of a specific army's gamepieces 22. Please see FIGS. 2,4,7,8. Furthermore, in the preferred embodiment, all designation marks 6 are further matched to a specific army wing 53,54 by: (i) solid colored circular designation marks 8,10,12,14 or (ii) solid colored circular designation marks 9,11,13,15 further comprising smaller black concentric circles 59.

In other embodiments generic designation marks 6 can be of any shape. Any color or design is within the scope of our invention which is (i) consistent within a group of linear marks 6 on border 16 and (ii) correlates with the color or design of a specific army 17. Each set of designation mark groups 9,11,13,15, and 8,10,12,14 comprise the color or design of army 17 gamepieces 22 located at the direct opposite corner 16a of gameboard 3.

As seen in FIG. 7, arrows 18*d* on squares 4 or 5 indicate initial movement and forward direction of Holy Wing Pawns 37*a*. In the preferred embodiment, Pawns 37*a* of Holy Wing 53 move forward towards identically colored circular designation marks 6 with concentric black circles 59 within 9,11,13,15.

Specific groups of Pawn 37 move forward in two different directions instead of one, in contrast to conventional chess. This is due to the fact that Pawns 37 of each army 17 move against two individual opponents according to their initial orientation as 37*a*, 37*b*, or 37*c*. These pawns 37, positioned directly along the vertical and horizontal axis of gameboard 3, initially guard each army 17. This is the case in all embodiments of our invention 1 of a modified conventional chess game.

As illustrated in FIG. 8, solid circular designation marks 8,10,12,14 indicate the forward direction of identically colored Pawns 37*b* of Head Wing 54. Arrows 18*e* on squares 4 or 5 indicated initial movement and forward direction of Pawns 37*b* of Head Wing 54.

In the preferred embodiment each set of circular designation marks 6 match the color of army 17 located at the direct opposite corner 16*a* of gameboard 3. However, our invention contemplates other size marks 6 with appropriate shapes, designs and colors.

Initial Arrangement of Game Pieces 22

Figure 9:
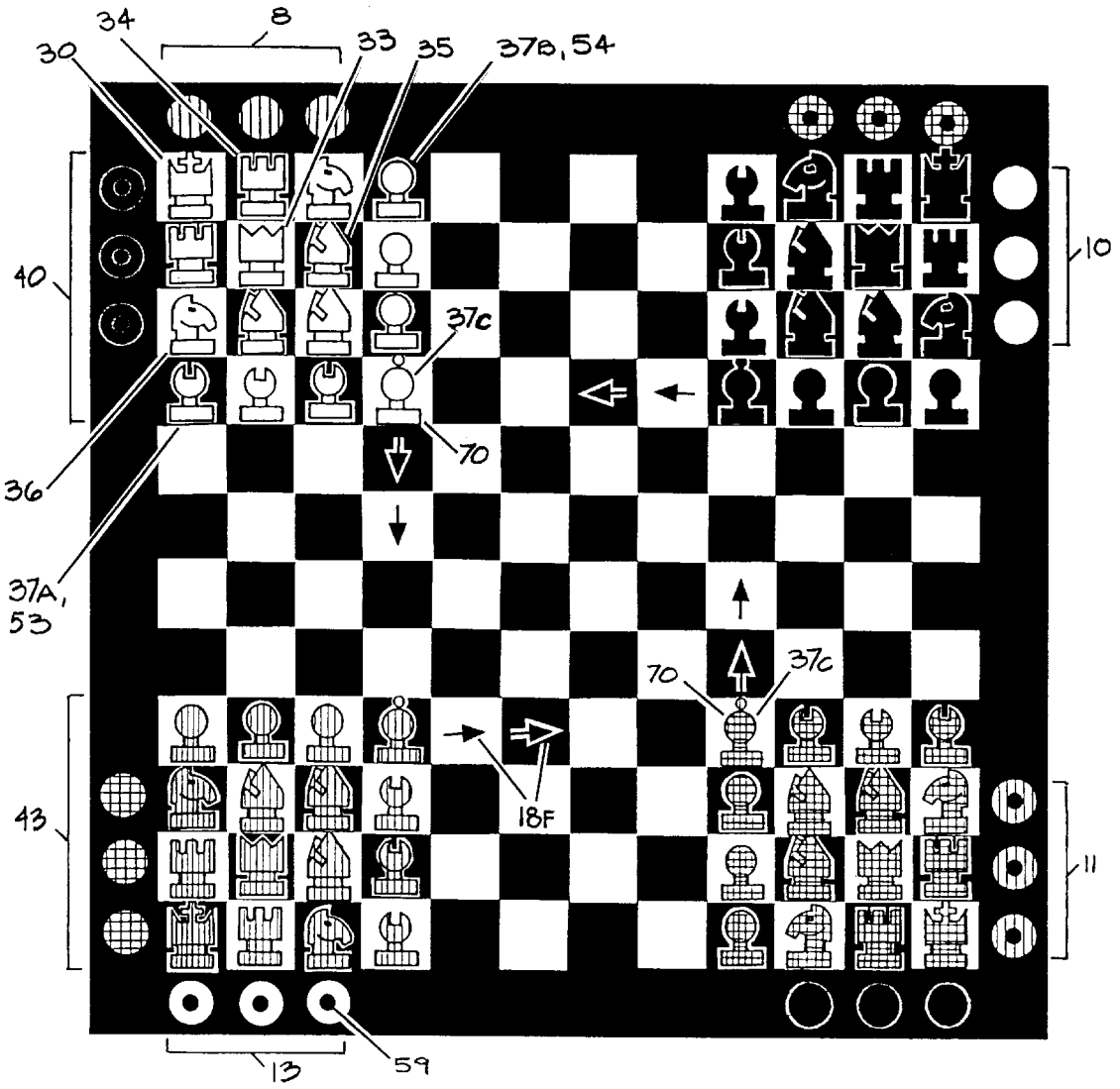
FIG. 9 illustrates a sample initial forward movement of a bi-directional pawn in the direction of the Holy Wing of his own army.

As seen in FIG. 9, game pieces 22 in each army 17 are initially arranged as follows in the preferred embodiments:

(a) King 30 is placed on the corner square 4 or 5 of gameboard 3 opposite and parallel to designation marks 6 matching that particular King's 30 color. For example, King 30 from Red Army 43 is opposite designation mark groups 8 and 11.

(b) Queen 33 is placed on the first square 4 or 5 diagonally from King 30 of the same color.

(c) Two Rooks 34 are initially positioned upon the first square 4 or 5 vertically and horizontally from King 30 of the same color army 17.

(d) Two Knights 36 are initially positioned upon second square 4 or 5 vertically and horizontally from King 30 of the same color.

(e) Three Bishops 35 are initially positioned upon first square 4 or 5 vertically, horizontally and diagonally from Queen 33 of the same color army 17.

(f) Seven Pawns 37 are initially positioned upon squares 4 or 5 in front of two Knights 36 and three Bishops 35 of the same color army 17.

Three Pawns 37*a* of Holy Wing 53 are initially positioned opposite designation marks 6 comprising concentric circles 59 and of matching army 17 color: 9,11,13,15, in the preferred embodiment. See FIG. 7.

Three Pawns 37*b* of Head Wing 54 are placed opposite solid circular designation marks 6 matching army color: 8,10,12,14. See FIG. 8.

Figure 13:
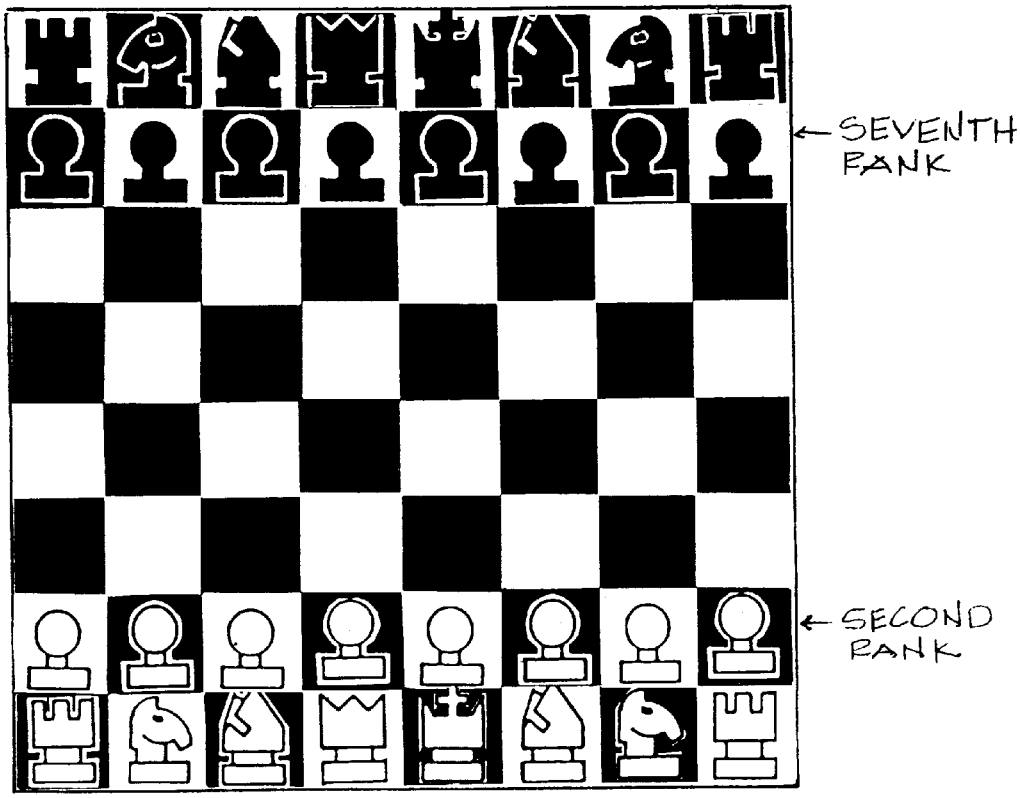
FIG. 13 is an upper plan view of a conventional chess arrangement.

As seen in FIG. 9, Pawn 37*c* is initially at the intersection square 70 of Head Wing 54 and Holy Wing 53. Our initial arrangement of Pawns 37 on gameboard 3 is novel: In conventional chess Pawns are initially positioned: (i) horizontally for the first army across the second rank of squares in a conventional chess gameboard and; (ii) across the seventh rank horizontally of squares for second army. Please see FIG. 13.

As illustrated in FIGS. 7,8, and 9 with four armies 17, Pawns 37 face either along the vertical and horizontal axis within one army 17. Thereafter each Pawn 37 moves forward along either the vertical or horizontal axis. Arrows on squares 4 or 5 indicate initial movement and forward direction of Pawns 37.

Figure 10:
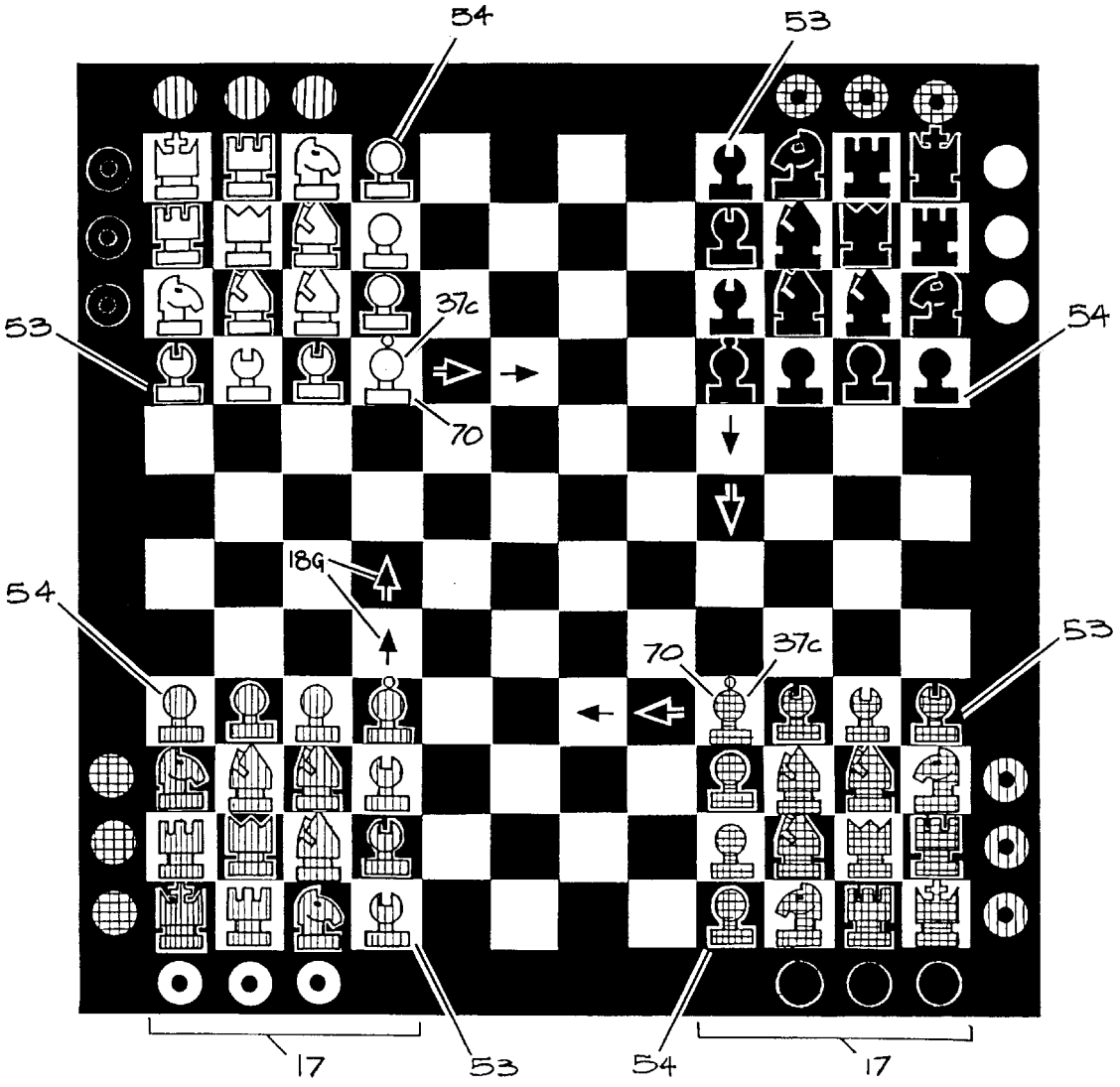
FIG. 10 illustrates a representative initial forward movement of a bi-directional Pawn in the directions of the Head Wing of his own army.

Referring now to FIG. 9, single Pawn 37*c* is initially placed at intersection square 70 of Head Wing 54 and Holy Wing 53. Consequently single Pawn 37*c* may, upon its first move proceed in the direction of either: (i) Pawns 37*a* of Holy Wing 53 as seen in FIG. 9 and as indicated by solid arrow 18*f*; or (ii) Pawns 37*b* of Head Wing 54, as indicated by solid arrow 18*g* in FIG. 10.

Figure 11:
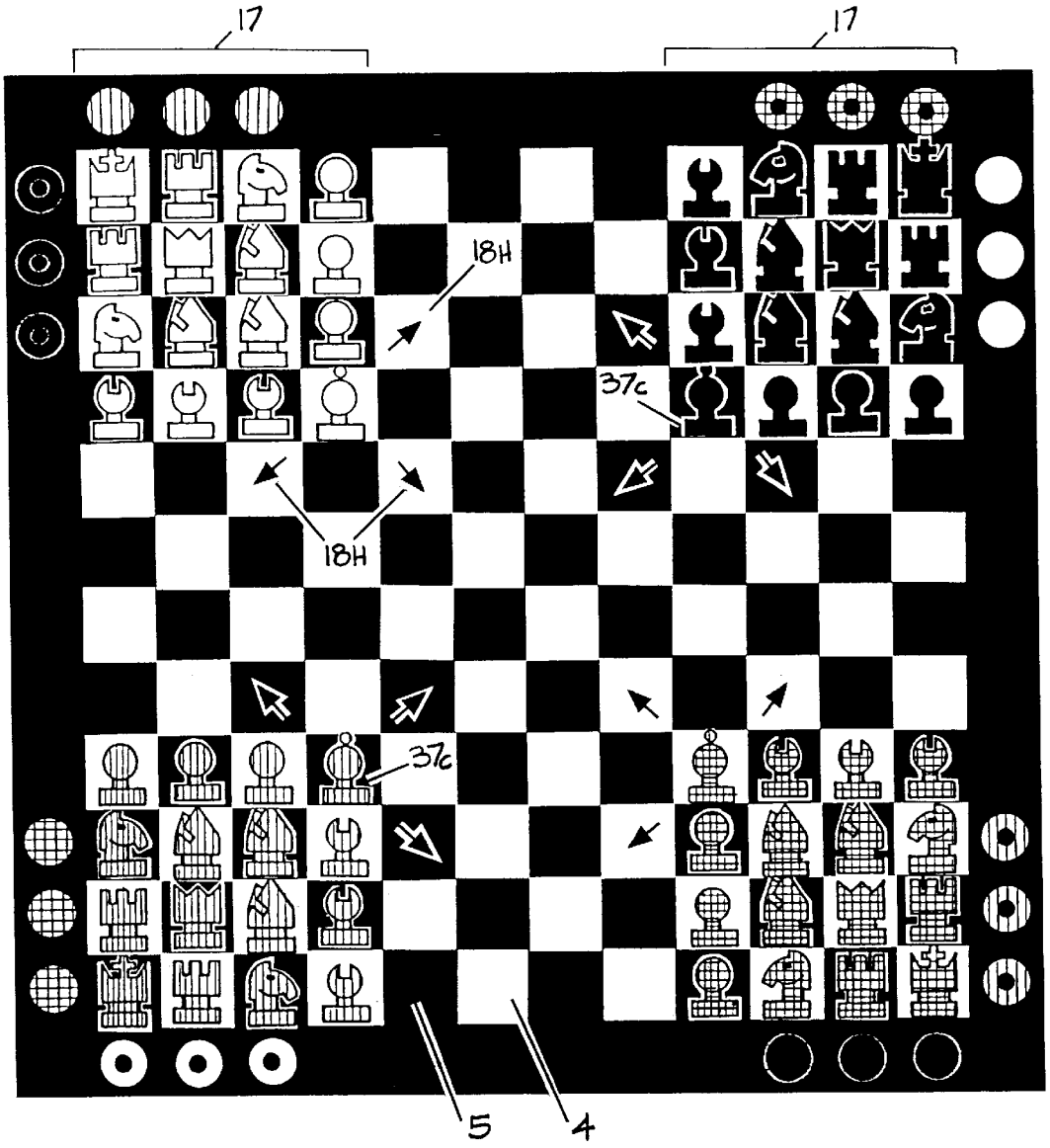
FIG. 11 illustrates initial forward positions on which a bi-directional Pawn may capture.
Figure 12:
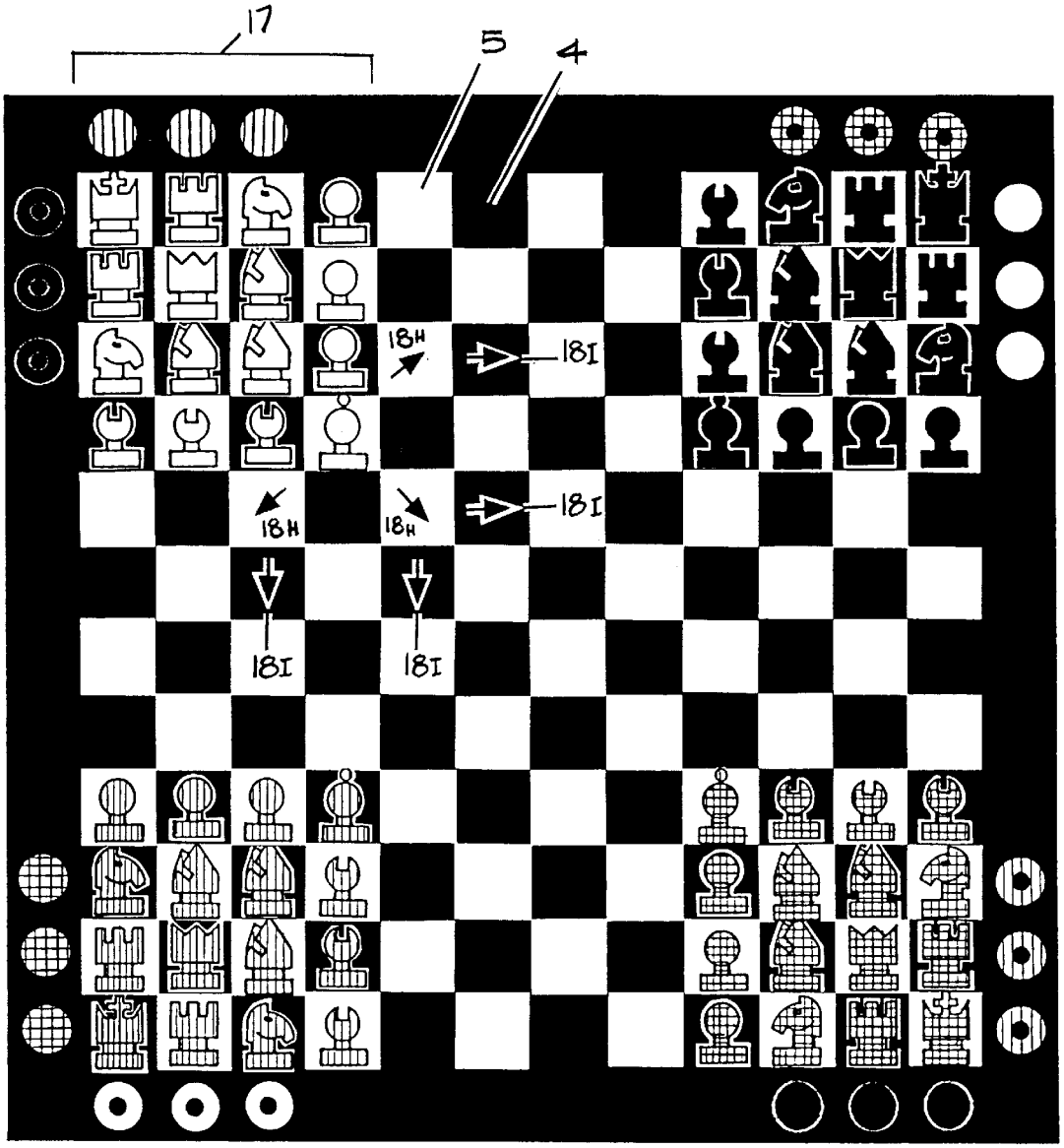
FIG. 12 illustrates initial forward positions on which White Army bi-directional Pawns may capture and subsequently move forward.

The initial forward positions on which Pawn 37*c* may attack, is illustrated in FIG. 11 by arrows 18*h*. The possible subsequent forward moves are illustrated in FIG. 12 by arrows 18*i*. Consequently, Pawn 37*c* may, upon its initial move, proceed towards either the Holy Wing or Head Wing designation marks 6 of which it is the same color or design e.g., either horizontally or vertically.

Alliance 60

Our invention allows two originally opposing armies 17 to jointly defend or launch attacks upon remaining opposing armies 17. Consequently, in an Alliance 60 two allied armies 17: (i) defend each other's pieces 22; and (ii) capture gamepieces 22 from opposing armies.

In an Alliance 60 two separate armies 17 retain their individual separate and original chronological turn (opportunity) to move along gameboard 3 to attack and capture (e.g., remove from the gameboard 3), gamepieces 22 foreign to their Alliance 60. In effect, Alliance 60 temporarily transforms an opposing army 17 comprising foreign gamepieces 22 into an ally.

This strategy allows a participant 27 to focus on eliminating remaining opposing armies 17.

Two, but no more than two, armies 17 can form an Alliance 60 if and only if the following conditions are met:

(a) Either King 30 of armies forming an Alliance 60 cannot be under "check." This condition allows a participant who has successfully maneuvered an opponent King 30 into a check position, to complete the checkmate (removal of opposing King 30 from gameboard 3), prior to that opponent King 30 seeking an ally's protection.

(b) One of two armies 17 must have eight or less pieces 22 remaining on gameboard 3. This condition prevents individual participants 27 from forming an Alliance 60 prior to any or little attrition of his or her army 17. This also gives an opportunity to an individual participant 27 to form an alliance 60 with an opposing army which has lost half its gamepieces 22.

Allied armies 17 must immediately verbally notify remaining participants 27 of their Alliance 60.

Allied armies 17 cannot capture each other's gamepieces 22. Therefore, the rules of "check" in our invention 1 of a modified conventional chess game are inapplicable between the two member armies 17 of Alliance 60. In an Alliance 60, allied gamepieces 22 can move onto or remain on squares 4 or 5, on which gamepieces 22 would ordinarily be captured if this same allied army 17 were an opponent.

However, there is an exception: an allied King 30 can move onto or remain on any square 4,5 attacked by an allied gamepiece 22, except for those positions attacked by an allied King 30. In other words, one of the two Kings 30 in an Alliance 60 cannot move onto a square attacked by the second allied King 30.

An example of how an Alliance 60 operates is as follows: Red and Yellow Armies 17 are in Alliance 60. Yellow King 30 can move into and remain on any square 4,5 checked by Red Army 17, except for squares checked by Red King 30. A more detailed example of the dynamics of an Alliance 60 is illustrated in FIG. 14:

Original status: Yellow Army 42 has 12 gamepieces 22 remaining; Black Army 41 has 8 gamepieces 22 remaining; White Army 40 has 12 gamepieces remaining 22; and Red Army 43 has 10 gamepieces 22 remaining. It is now Black Army 41's chronological turn to move. Black Army has eight gamepieces 22 remaining on gameboard 3 and Black King 30 is not in 'check.' Prior to moving, participant 27 controlling Black Army 41 verbally offers an Alliance 60 to White Army 40. White Army 40 verbally declines. Black Army 41 verbally offers Alliance 60 to Yellow Army 42. Yellow Army 42 verbally accepts. Consequences: White/Red Armies 17 verbally notified of Black/Yellow Alliance 60.

Continuing the example immediately preceding, after Alliance 60 is established, Black Bishop 35 moves to capture White Pawn 37*c*. The move of Black Bishop 35 is indicated by solid black arrow 80 as seen in FIG. 14.

Figure 14:
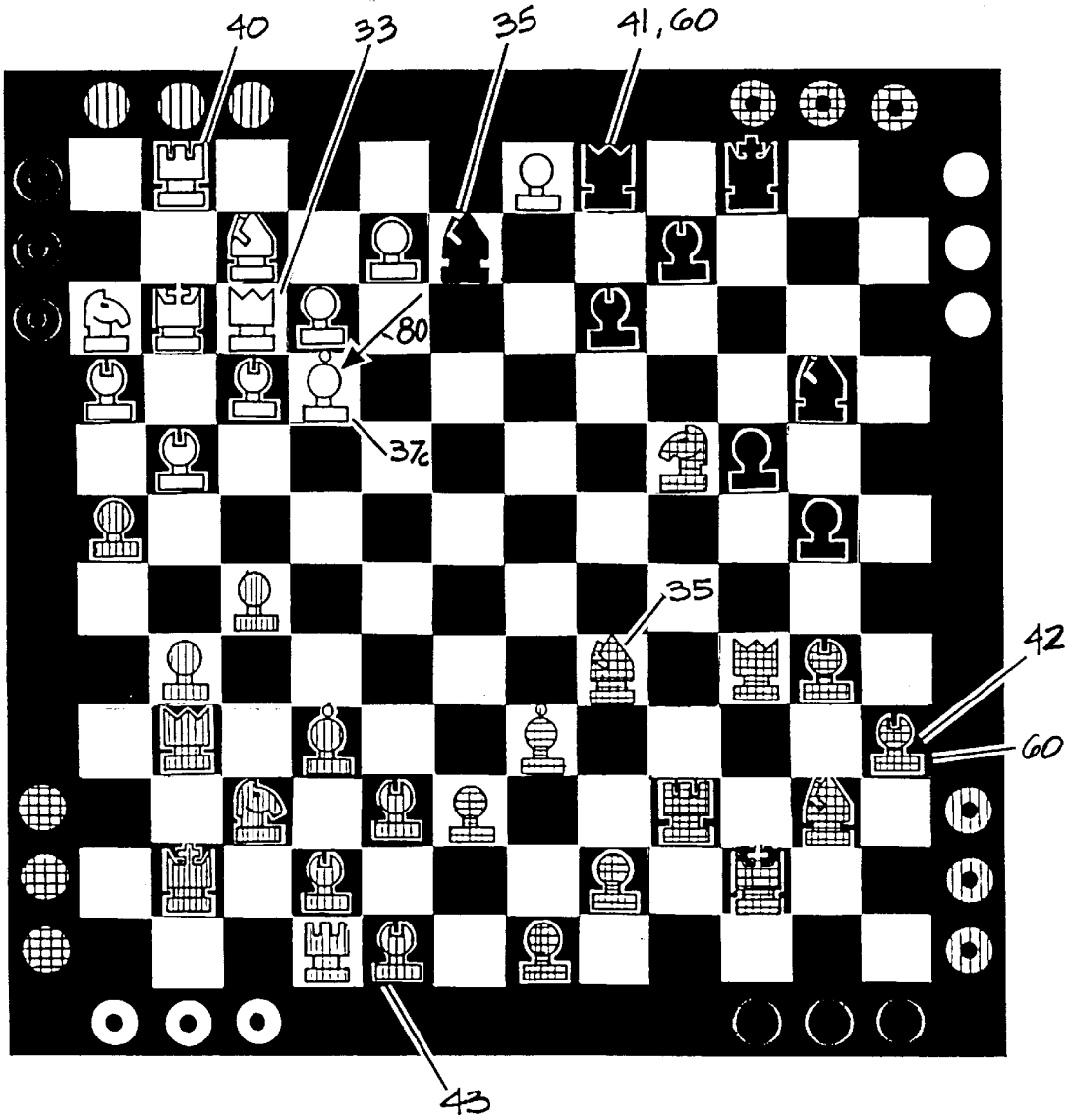
FIG. 14 illustrates an Alliance.
Figure 15:
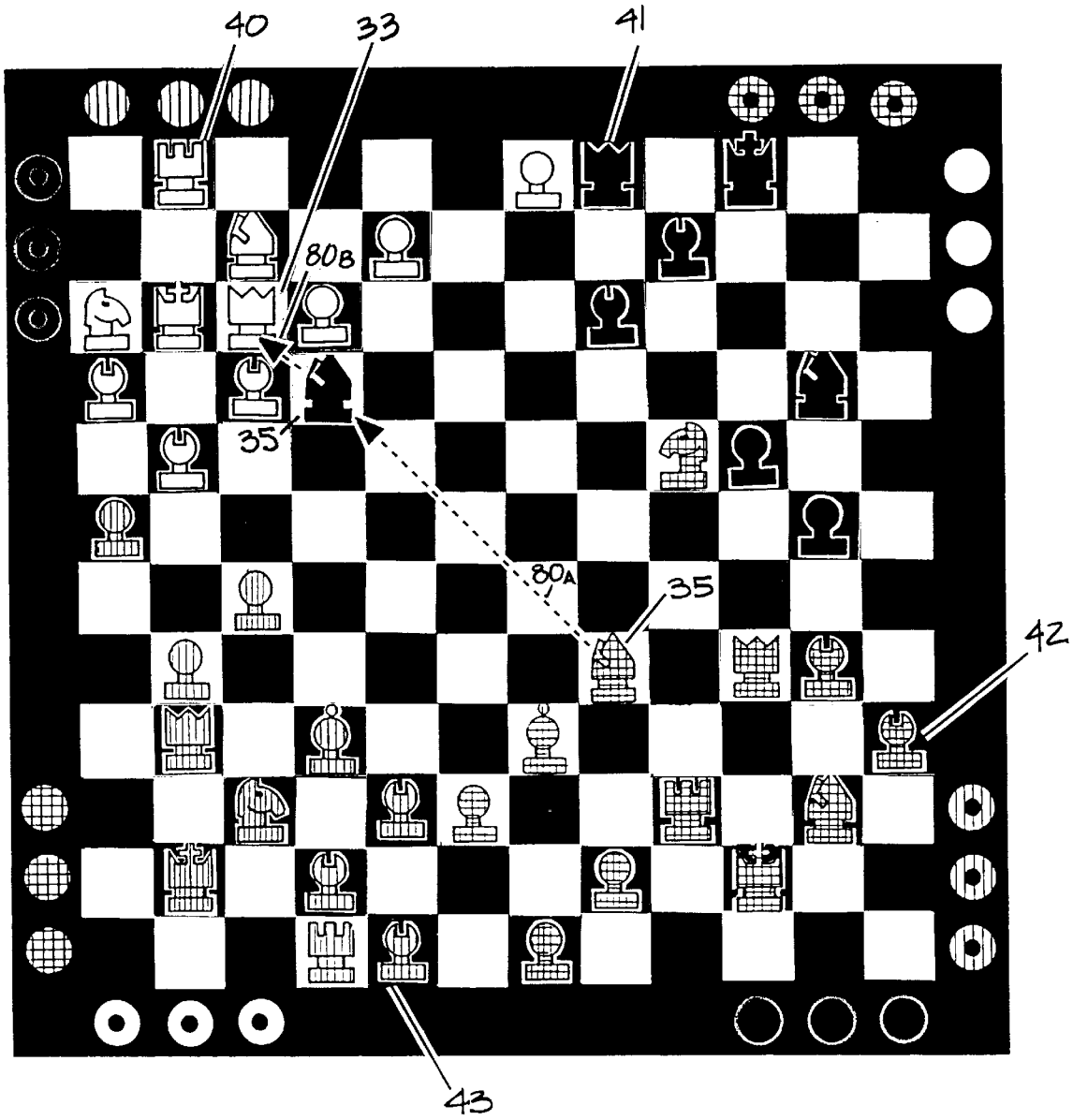
FIG. 15 illustrates the consequences of an Alliance on an opponent army.

After Black Bishop 35's move in FIG. 14, FIG. 15 illustrates the consequences thereof. Black Bishop 35 is now in a position to attack White Queen 33, as indicated by dashed arrow 80*b*. Black Bishop 35 is also in a position which is now protected by its ally, Yellow Bishop 35, as indicated by dashed arrow 80*a*.

This is also an example of a joint ally attack on an opponent. In this case one of the allied gamepieces 22, Black Bishop 35, uses protection of the other allied gamepiece 22, Yellow Bishop 35, to attack an opponent, White Queen 33.

In sum, our invention 1 of a modified conventional chess game allows two armies 17 to jointly (i) defend; (ii) attack; or (iii) when defended by an allied army 17, attack an opponent's gamepiece 22. However, a first Army 17 of Alliance 60 cannot assume the chronological move or opportunity to move, of second Alliance army 17. Formation of an Alliance 60 is optional within the proceedings of our game.

Dissolution of an Alliance 60 results in two formerly allied armies 17 reverting to opposing armies 17. Dissolution eliminates the possibility for two armies 17 to prevail as an Alliance 60 at the end of the game. Allied armies 17 dissolve and revert to the status of opponents under the following conditions:

(a) When a member allied army 17 defeats an opposing army by checkmating that Army's King 30. For example, Black and Red Armies 17 are in Alliance 60 and Red Army 43 defeats Yellow Army 42 by capturing (physically eliminating from gameboard 3) Yellow King 30. Red Army 43 now immediately controls Yellow Army 42. This new domination automatically dissolves Alliance 60 of Black and Red Armies 17 in all embodiments of our invention 1 of a modified conventional chess game.

(b) When an opposing army 17 defeats an Alliance 60 army 17 by capturing (and permanently eliminating from gameboard 3) an allied King 30. For example, Black Army 41 and Red Army 43 are in Alliance 60. A gamepiece 22 of Yellow Army 42 checkmates Red King 30 and removes it from gameboard 3. Now Yellow Army 42 immediately controls Red Army 42. This new dominion automatically dissolves Alliance 60 of Black and Red armies 17.

Once an Alliance 60 is dissolved, a new Alliance 60*a* can be formed under the above rules for Alliances 60.

Great Army 67

In the preferred embodiment, and other embodiments of our invention 1, a participant 27 can control several armies 17 simultaneously, thus creating Great Army 67. This occurs when (i) gamepiece 22 from opposing army 17 checkmates an opposing King 30; and (ii) that King 30 is removed from gameboard 3 during a subsequent chronological turn of the opposing gamepiece 22.

Once a King 30 is checkmated and removed from gameboard 3, remaining pieces 22 of that King's army 17 are controlled by capturing army 17. Capturing army 17 then appropriates defeated army's 17 chronological turn to move and retains its original chronological turn as well.

Figure 29:
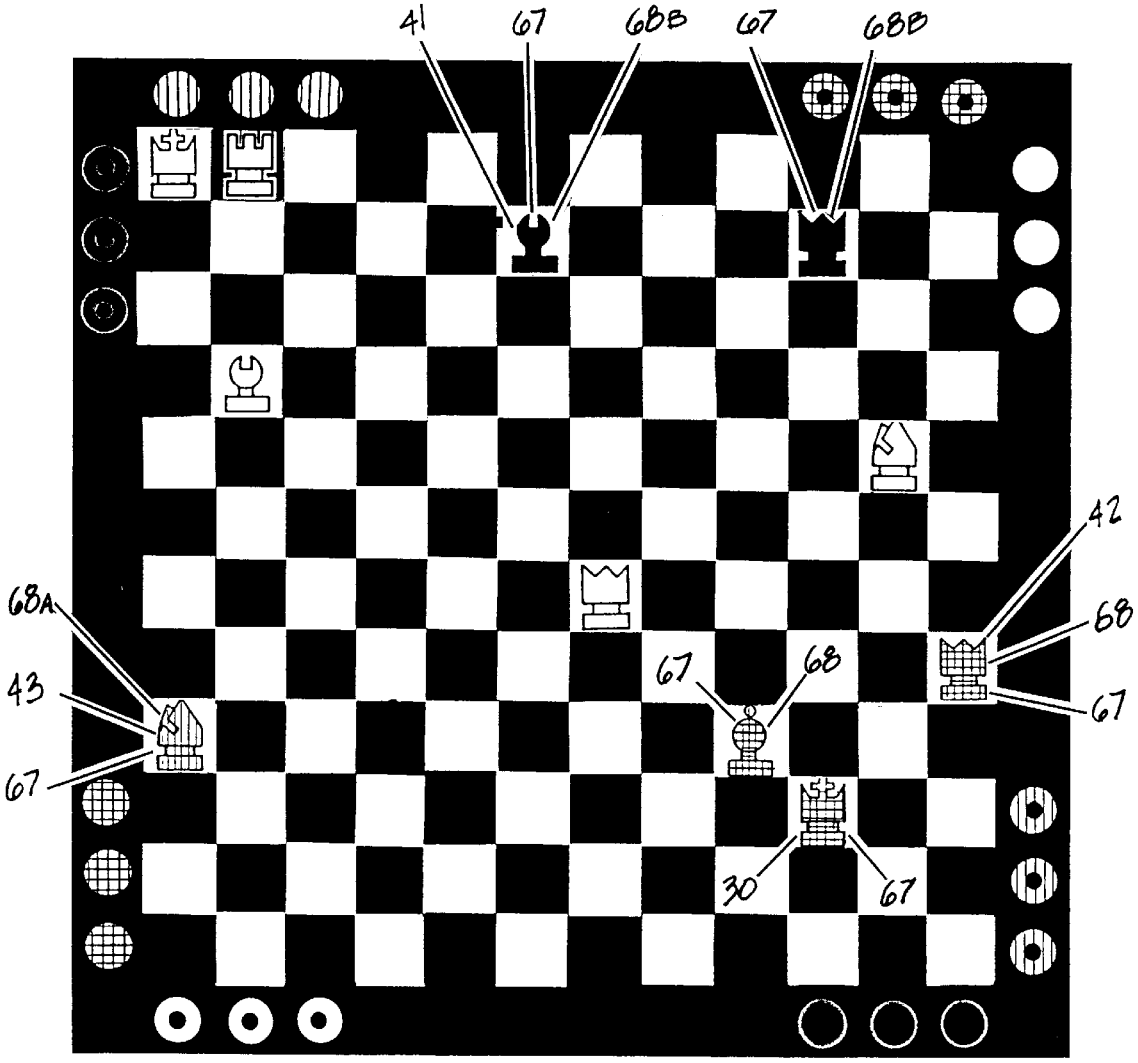
FIG. 29 illustrates a Great Army composed of three divisions.

As illustrated in FIG. 29, Great Army 67 is composed in part of divisions 68*a*,68*b*, which are remnants of originally independent opposing armies 17. Central Division 68 contains King 30 of originally capturing Yellow army 17. The remaining divisions 68*a*,68*b* of Great Army 67 are former armies 17 which were defeated by Central Division 68 (originally yellow Army 17). A Great Army 67 can contain one or more than one defeated army 17. For example, presume that Yellow Army 42 defeats Red and Black Armies 17. Yellow Army 42 now is Central Division 68 of Great Army 67. Yellow King 30 is now King 30 of Great Army 67. Former Red Army 43 is now the Red Division 68*a* of Great Army 67. Former Black Army 41 is now the Black division 68*b* of Great Army 67, as illustrated in FIG. 29.

Figure 30:
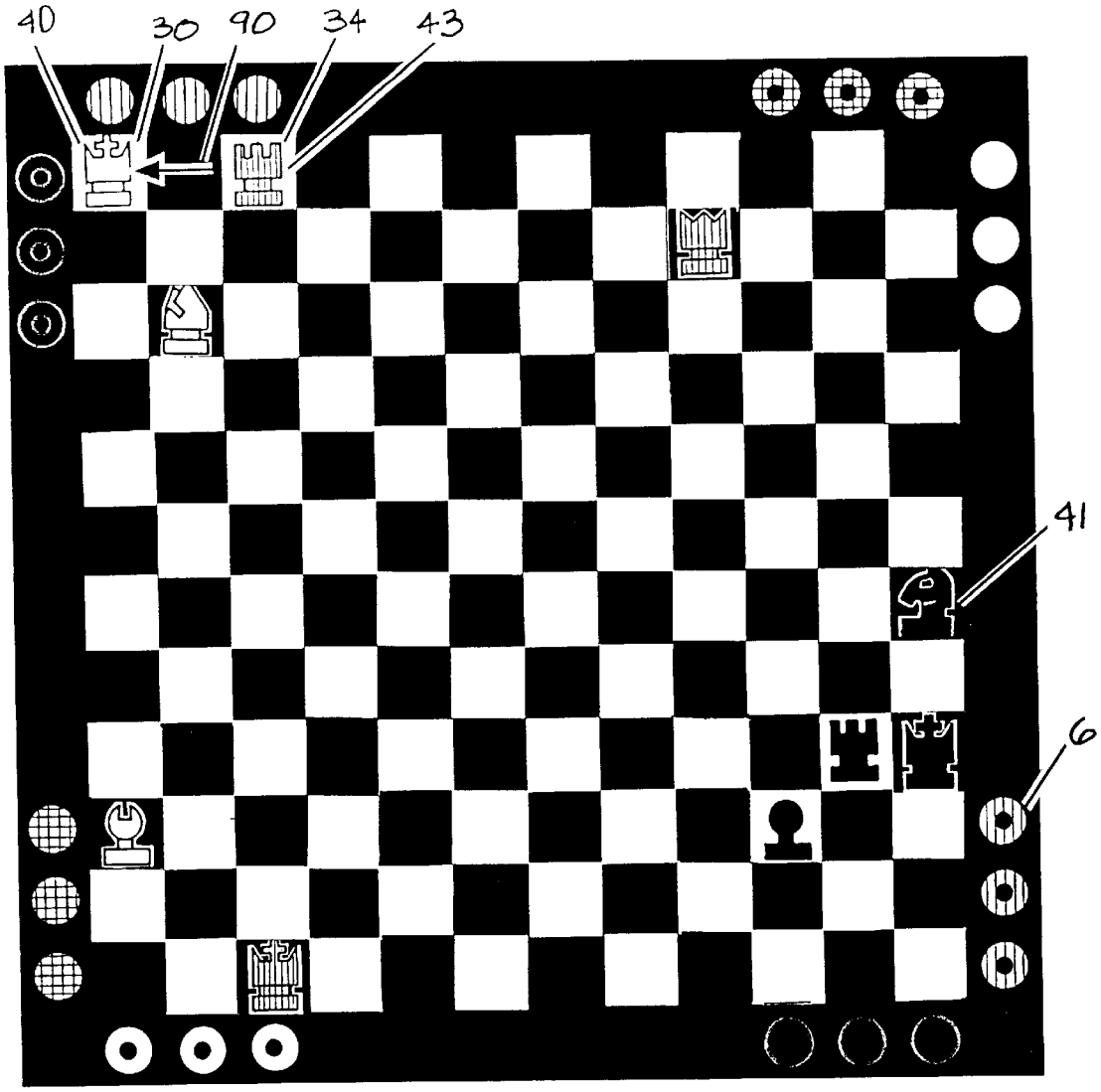
FIG. 30 is an example of the creation of a "Great Army," illustrating the chronological turn and move of the Red Army.
Figure 31:
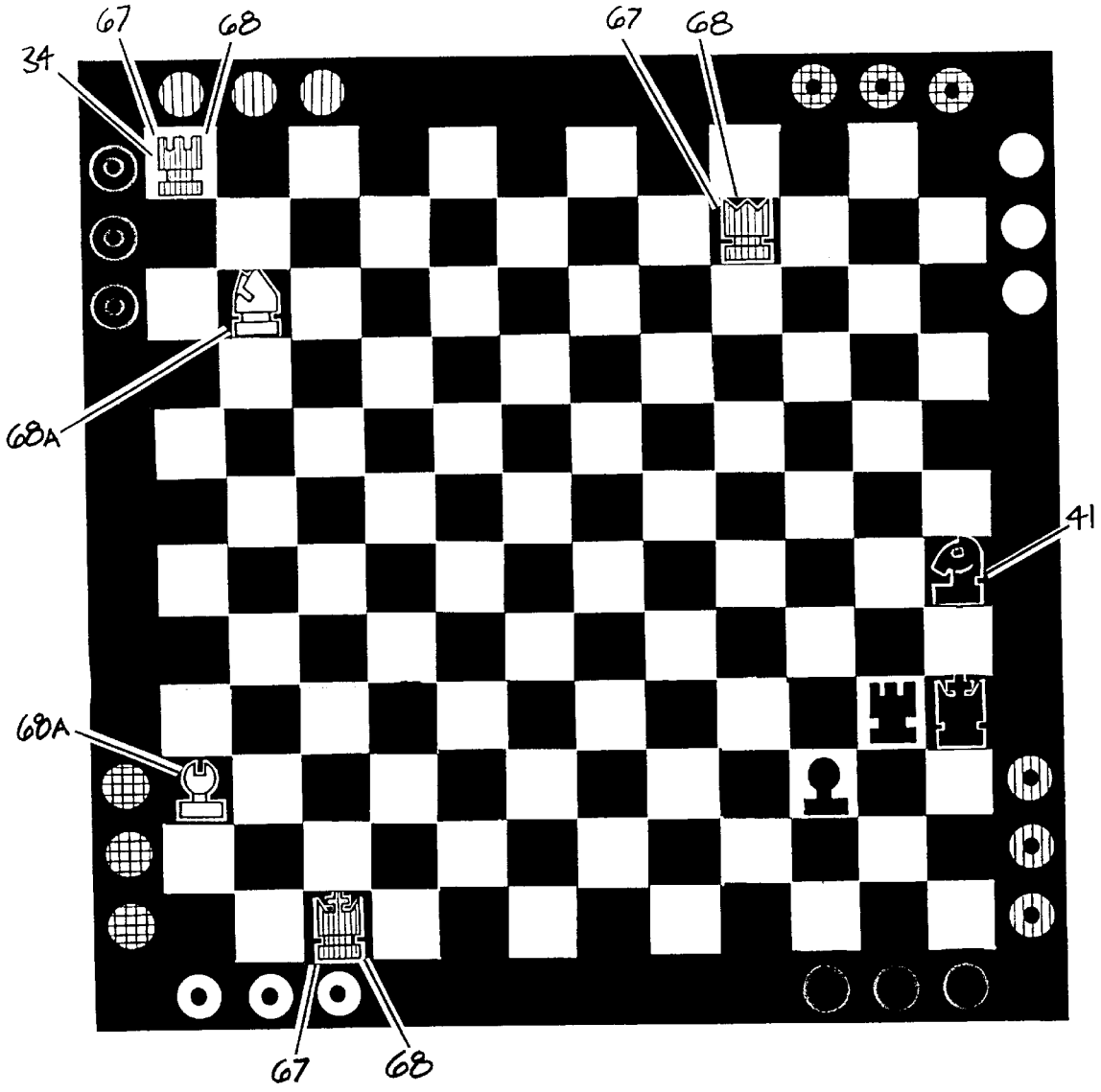
FIG. 31 is an example of a "Great Army," which shows the conclusion of the example of FIG. 30."

Another example of the creation of a Great Army 67 is illustrated in FIG. 30. Three opponent armies 17 remain on gameboard 3, with order of play: Red Army 43, White Army 40, and Black Army 41. Red Rook 34 moves (see solid arrow 90) and checkmates White King 30, which is subsequently removed from gameboard 3. At this instant White Army is defeated and immediately incorporated as a division of Red Army, as shown in FIG. 31. Red Army 17 now becomes a Great Army 67 with a White Division 68*a* and a Red Central Division 68.

Great Army Divisions 68, 68*a*,68*b* can only capture each others' Pawns 37. This exception prevents Pawns 37 in different divisions 68,68*a*,68*b* within a Great Army 67 from blocking each other's forward movements. Interactions of Great Army Divisions 68,68*a*,68*b*, include the following:

(a) Great Army divisions 68, 68*a*,68*b* cannot capture each other's gamepieces 22 except for Pawns 37, as discussed supra. Therefore conventional rules for "check" are inapplicable between division of a Great Army 67 in our invention 1 of a modified conventional chess game.

(b) When Great Army King 30 is under "check", all Great Army divisions 68*a*,68*b* can move, except for Central Division 68. Central Division 68 cannot move until King 30 of Great Army 67 is removed from "check."

Figure 32:
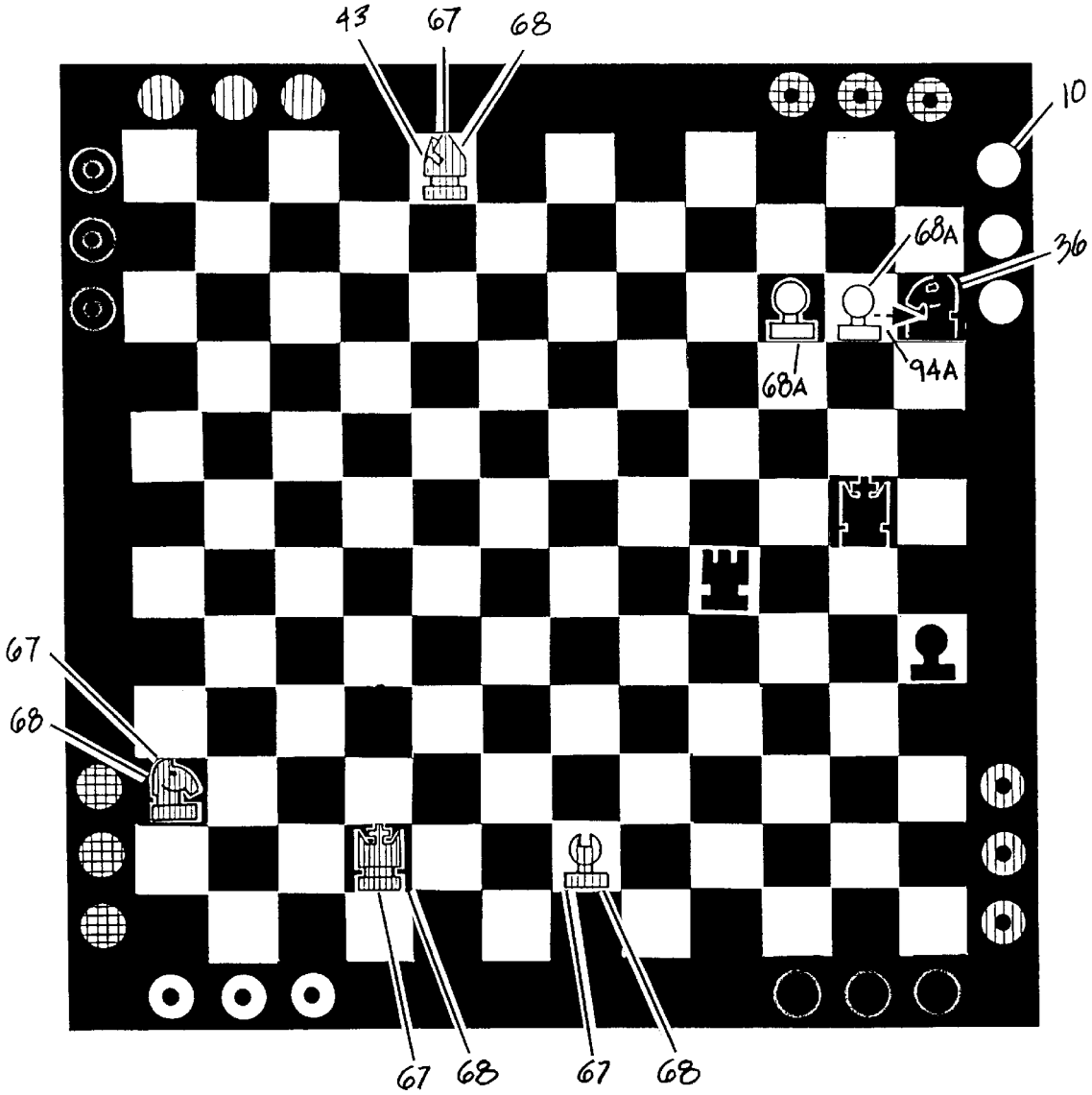
FIG. 32 illustrates a Great Army Division which is blocked during its chronological turn to move.

(c) A defeated army 17 (E.g., a division 68*a*) retains its chronological turn to move along gameboard 3 if its gamepieces 22 are unobstructed by opposing gamepieces 22 of opposing armies 17 or member divisions 68. An example of this situation is illustrated in FIG. 32:

In FIG. 32, Great Army 67 comprises Red Central Division 68 and White Division 68*a*. It is White Division 68*a*'s turn to move. White Division 68*a*, in this particular example, is represented by two White Head Wing Pawns 37*b*. These two White Head Wing Pawns 37*b* cannot move forward as indicated by dashed arrow 94*a*, because they are blocked by Black Knight 36.

As a result, White Division 68*a* loses every chronological opportunity to move along gameboard 3, as long as its Pawns 37 are blocked by Black Knight 36.

When Great Army King 30 is checkmated and removed from gameboard 3, capturing army 17 asserts control over all Divisions 68,68*a*,68*b* of the previous great Army 67. This creates a new Great Army 67*b*.

The Modified Methodology for Checkmate

In our invention 1, as in conventional chess, the goal is for the chronological move of a gamepiece 22 to place an opposing King 30 in check, from which the checked King 30 cannot escape. In direct check an opposing gamepiece moves and itself places an opposing King in check. With indirect check, a gamepiece 22 moves and clears a path for a second stationary gamepiece 22 (of its own army or a different army) to check a stationary opposing King 30. The gamepiece 22's move is to capture the checked King 30 and remove it physically and permanently from gameboard 3. Our invention 1 defines this crucial second chronological move as "checkmate."

Conventional chess (See FIG. 13) as discussed supra, defines defeat of an army as the move which places an opponent's King in check from which the checked King cannot escape. Conventional chess defines this move as "checkmate," and since there are only two opposing armies, the game immediately terminates.

In our invention 1 of a modified conventional chess game, an attack which places an opponent's King 30 in check from which checked King 30 cannot escape is not necessarily fatal. Instead,our King 30 must be checkmated in one move and physically removed from gameboard 3 in a subsequent (usually the next) chronological turn of the checkmating opponent.

Between those two chronological turns, events occurring on gameboard 3 involving gamepieces 22 of other armies 17 can change the outcome of checked King 30's fate. Placing a King 30 under check is only the first move that places a King 30 in a position from which he cannot escape. Subsequently, checkmated King 30 can be physically removed from gameboard 3 by his opponent only if other specific events on gameboard 3 do not occur, between the opponent's two chronological moves.

Our invention's novel methodology 2 allows a participant's King 30 to move into a check position and elude checkmate under the following conditions:

Situation (a): When King 30 is checked by an allied gamepiece 22 which is not itself a King 30. As discussed supra, armies 17 in Alliance 60, cannot capture (and remove from gameboard 3) each other's gamepieces 22.

Situation (b): When a King 30 is checked by a gamepiece 22 of a non-alliance army 17, whose own King 30 is simultaneously checked by a third army gamepiece 22. For this condition to occur, there must be more than two opposing armies 17 remaining on gameboard 3.

Figure 16:
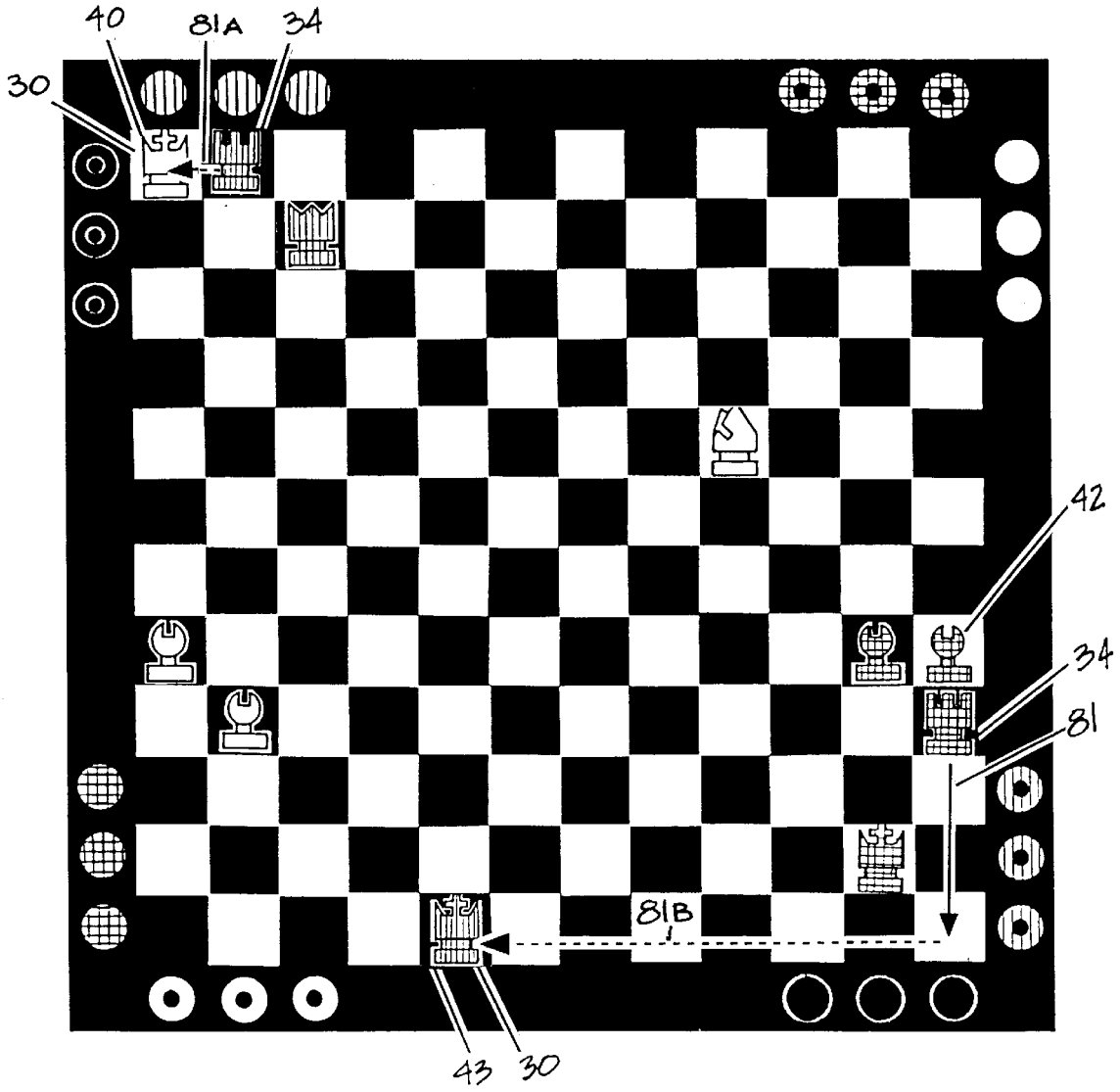
FIG. 16 is part of an example illustrating a King moving into a position checked by an opponent when that opponent's own King is under check by a third opposing army.

In situation (b), King 30 can be checked by an opposing gamepiece 22, only if opposing gamepiece 22 at that same time, has its own King 30 under check by an opposing third army gamepiece 22. This aspect of our invention depends upon the chronological order of movement of more than two opponent armies, and is illustrated in FIGS. 16,17,18,19,and 20: The example in FIG. 16 is wherein Red Rook 34 has placed White King 30 under check (indicated by dashed arrow 81*a*). In this example, there are three separate opponent armies 17 on gameboard 3.

Continuing the description of situation (b), chronological order to move in FIG. 16 is: Yellow Army 42; next White Army 40; and finally Red Army 43. FIG. 16 illustrates that White King 30 is checked by Red Rook 34 (indicated by dashed arrow 81*a*). It is now Yellow Army's chronological turn to move. At this point in situation (9), the most important move will be the next chronological move of Yellow Army gamepiece 22 which has two options: (i) to prevent White King's 30 capture; or (ii) to totally disregard White King 30's predicament.

We have chosen, for this example in situation (b), how a King 30 can escape checkmate (capture) by moving into a position checked by a gamepiece 22 whose King 30 is simultaneously checked by an opponent third army gamepiece 22. Here, the Yellow Army, during its chronological turn to move, places Red King 30 under check.

We now have a gamepiece 22 on the gameboard 3 which allows White King 30 to move into any position checked by Red Army, as long as the Red King 30 is under check. So, as shown in FIG. 16, Yellow Rook 34 moves as indicated by solid arrow 81, to check Red King 30 as indicated by dashed arrow 81*b*.

Yellow Rook 34 moves to the corner white square, as indicated by solid arrow 81. As a result of Yellow Rook's 34 move, Yellow Rook 34 now checks Red King 30. This result is indicated by dashed arrow 81*b*.

Figure 17:
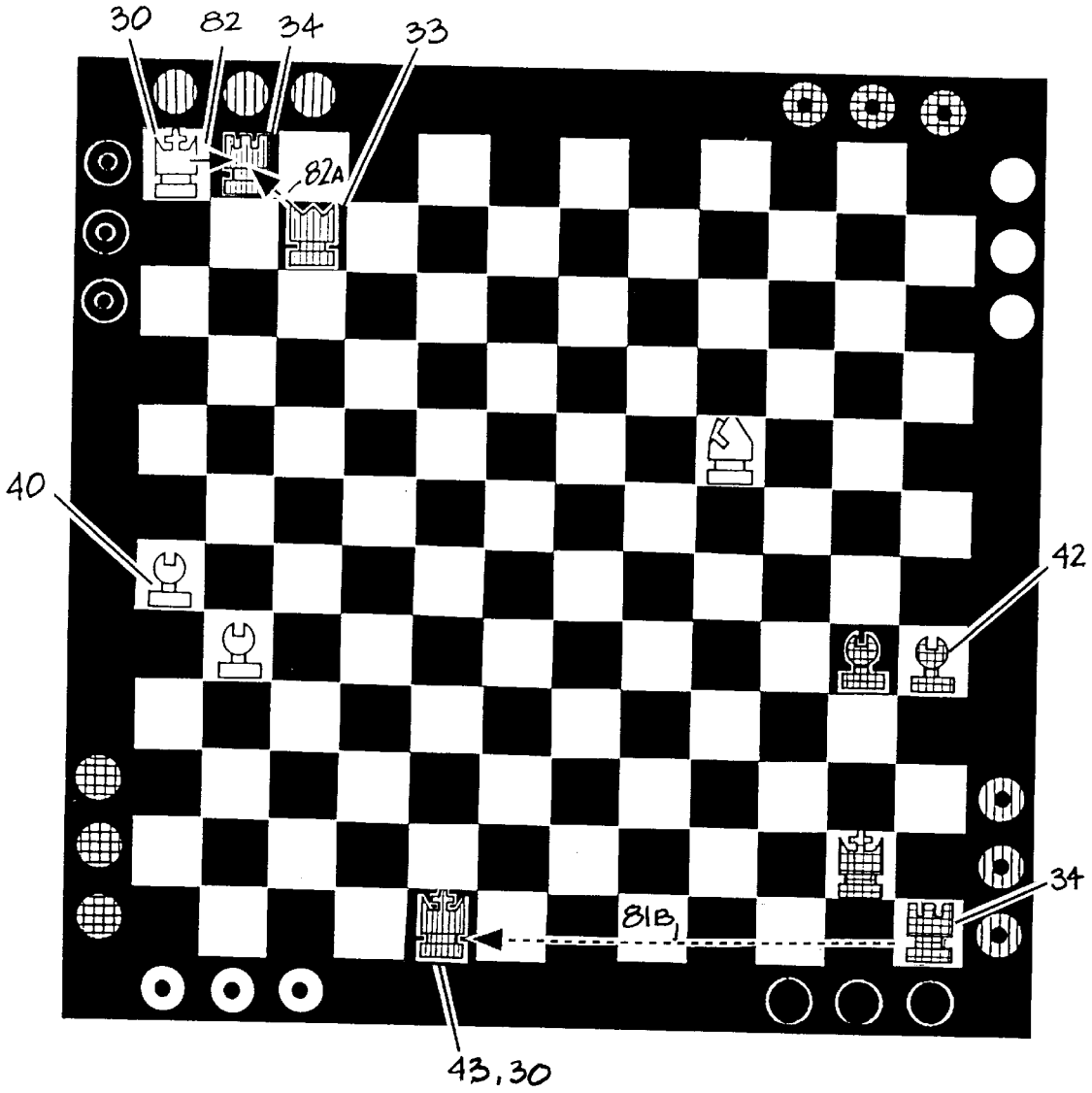
FIG. 17 continues the example on FIG. 16 and indicates the chronological turn and move of the White Army.

Continuing the strategy of situation (b), it is now White Army's 17 chronological turn to move, as illustrated and continued in FIG. 17. Solid arrow 82 indicates White King's 30 move on gameboard 3. White King 30 moves to capture Red Rook 34, thereby placing White King 30 in a position checked by Red Queen 33 (and as indicated by dashed arrow 82*a*). White King 30's move into a position apparently checked by opponent Red Queen 33 is possible, because 33 Red King 30, is simultaneously in check (as indicated by arrow 81*b*) by opposing Yellow Rook 34 of a third opposing army 17.

Figure 18:
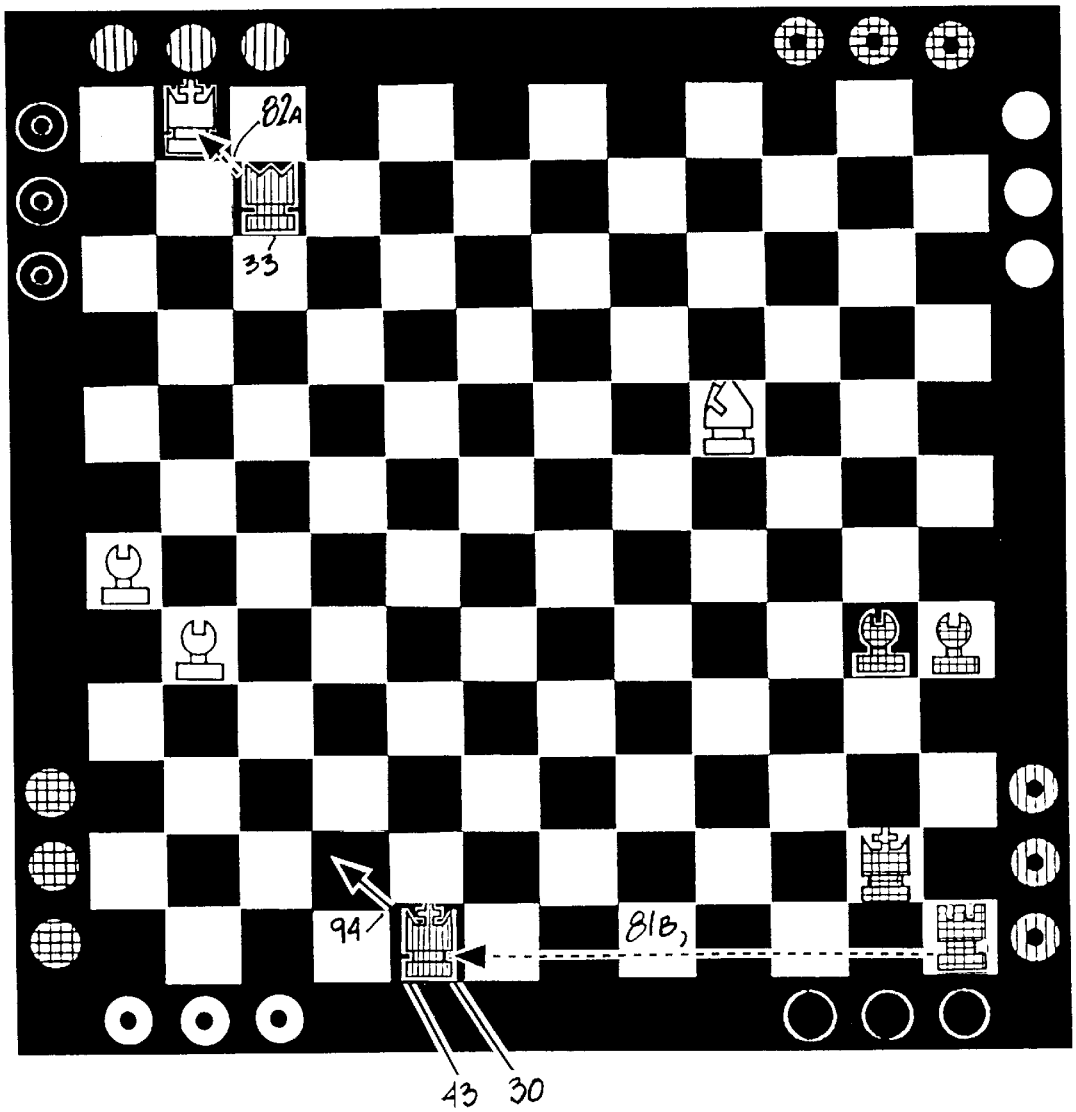
FIG. 18 illustrates continuation of the example on FIG. 16 and FIG. 17, indicating the chronological turn and move of the Red Army.

As illustrated in FIG. 18,and continuing with situation (b), it is now Red 43 Army's chronological turn to move. Red Queen 33 cannot move to capture White King 30 (indicated by dashed arrow 82*a*). Specifically, Red Queen 33 cannot move because Red King 30 is checked by third opposing army gamepiece Yellow Rook 34, here illustrated by dashed arrow 81*b*. In this situation Red Army 17 must remove its own King 30 from check, before any Red gamepiece 22 can move.

Consequently, Red Army 43 has no option but to remove its King 30 from check. Red King 30 moves (see solid arrow 94) away from the check position immediately thereafter during its own chronological turn. Red King thereby removes itself from check and inevitable checkmate, as a result of Yellow Rook 34's move.

In sum, in the above example of situation (b) a King 30 eluded checkmate when its checked position is itself: (i) checked by a gamepiece 22 such as Red Queen 33, as illustrated by dashed arrow 82*a* and; (ii) whose own Red King 30 is in check by a third opposing army gamepiece 22, in this case Yellow Rook 33.

Furthermore, in this same example of situation (b), immediately supra, during Yellow 42 Army's chronological turn to move (See FIG. 19), Yellow Holy Wing Pawns 37*b* (see arrow 83) move forward towards designation marks 6 comprising yellow circles 9 further comprising black circles 59. In FIG. 20 during White 40 Army's chronological turn to move, White King 30 captures Red Queen 33, as shown by solid arrow 84. As in conventional chess, in our invention 1 Kings 30 move and capture vertically, horizontally, and diagonally one square at a time.

In conclusion, the above examples in situation (b) in FIGS. 16,17,18, 19, 20 illustrate how a single King 30 can: (i) move into a position of check without necessarily being captured (ii) escape checkmate and (iii) capture opposing gamepieces 22 in the process.

The basis for significant features of situation (b) is the chronological order of moves of more than two participant armies 17 (in one game) on gameboard 3. FIG. 18 illustrates the delaying effect of Red Army's chronological turn to move. Prior to this second move, White King 30 escapes from the checkmate position, because Red Army 17 must remove its Red King 30 from check by Yellow Rook 34.

Figure 19:
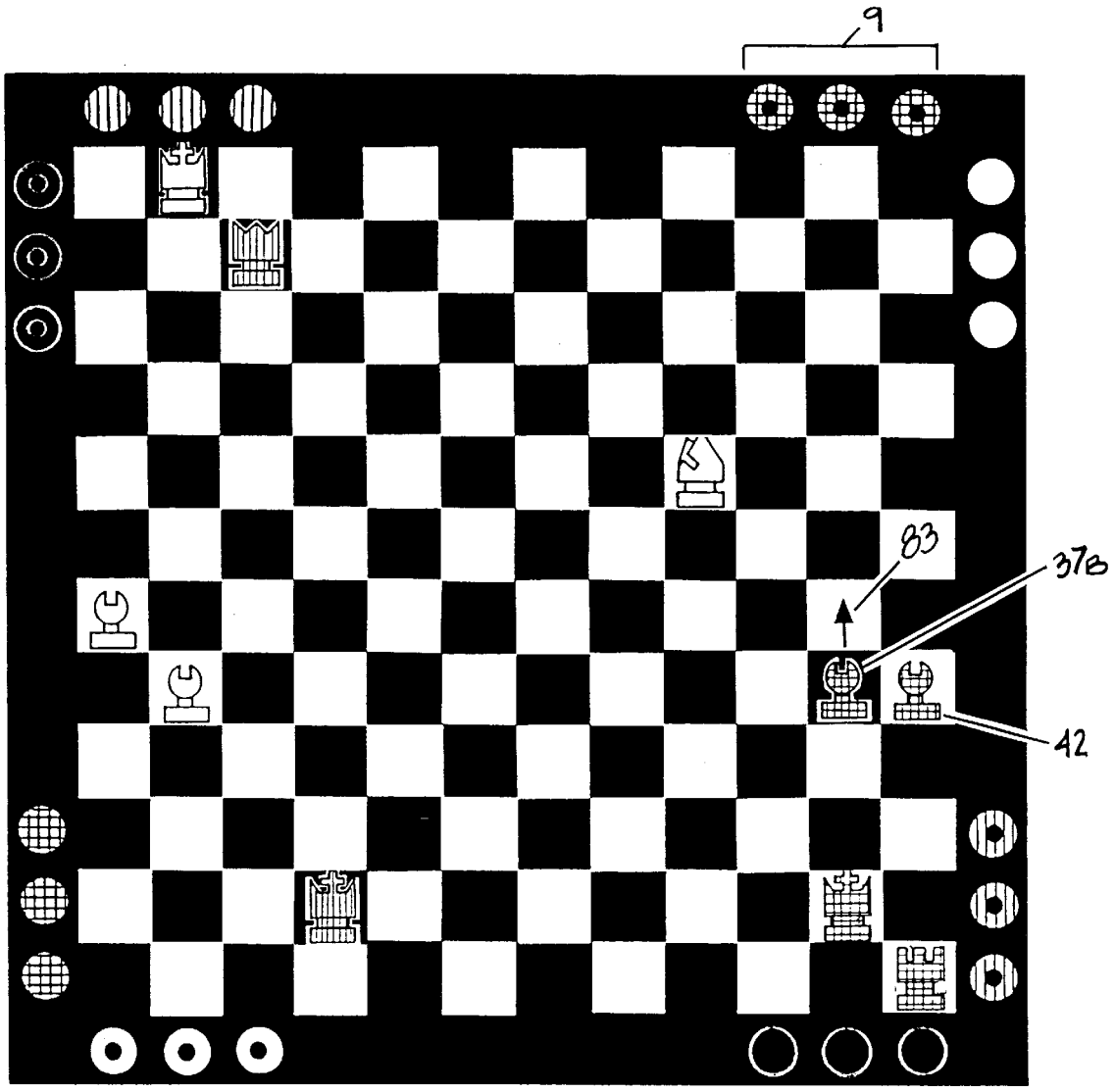
FIG. 19 is a continuation of the example on FIGS. 16, 17,18, indicating the chronological turn and move of the Yellow Army.
Figure 20:
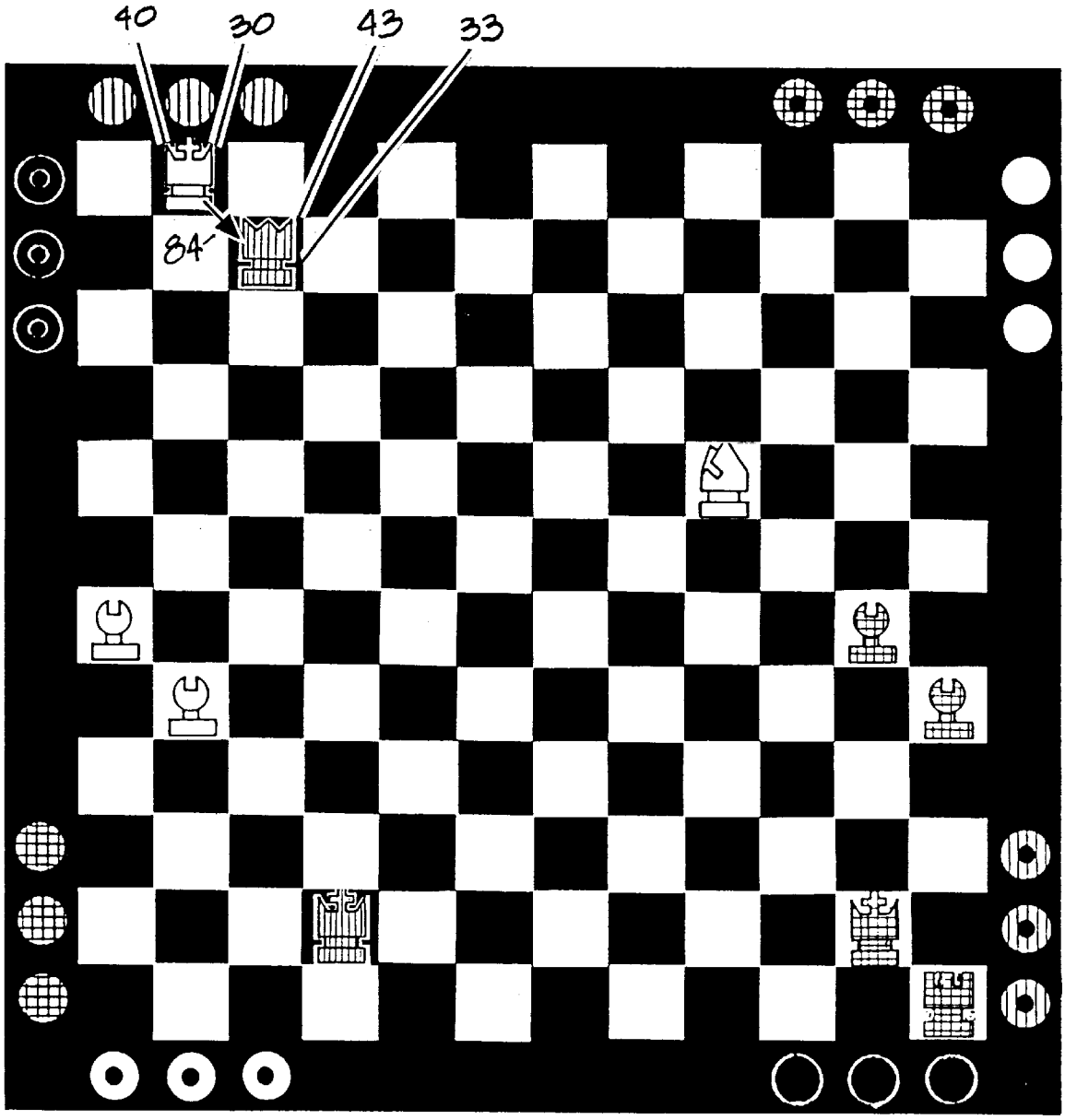
FIG. 20 is a continuation of the example of FIGS. 16,17,18,19, indicating the chronological turn and move of the White army.

Finally, FIG. 19 illustrates Yellow Pawn 37 movement during its appropriate chronological turn to move. FIG. 20 illustrates White King 30 moving and capturing Red Queen 33. Again, the basis for this significant feature is the chronological order of moves, or turns, of more than two participant armies on gameboard 3 during one game of our invention 1 of a modified game of conventional chess.

Situation (b), in sum, illustrates at least one distinct difference between conventional chess and our invention 1 of a modified conventional chess game. The advantage for a King 30, unlike conventional chess, is that a King 30 can remove himself from a checked position, escape capture, and even capture opposing gamepiece 22.

In this series of illustrations for situation (b), White King 30 was originally placed under check, which could have turned into a checkmate. Instead, White King 30 eluded checkmate and captured two powerful gamepieces, an opposing Rook 34 and Queen 33. In other words, the King's options are based on chronological order of opposing armies' 17 turns to move along gameboard 3, and not only between two opposing gamepieces as in conventional chess.

Situation (c): A participant's King 30 can also move into a check position by (i) methodology of Great Army 67 coupled with (ii) chronological order of moving. King 30 of a Great Army can move into a checked position if that checked position is defensible by (i) Division 68*a* of Great Army 67 (ii) prior to an opponent's chronological turn to checkmate Great Army King 30.

Figure 21:
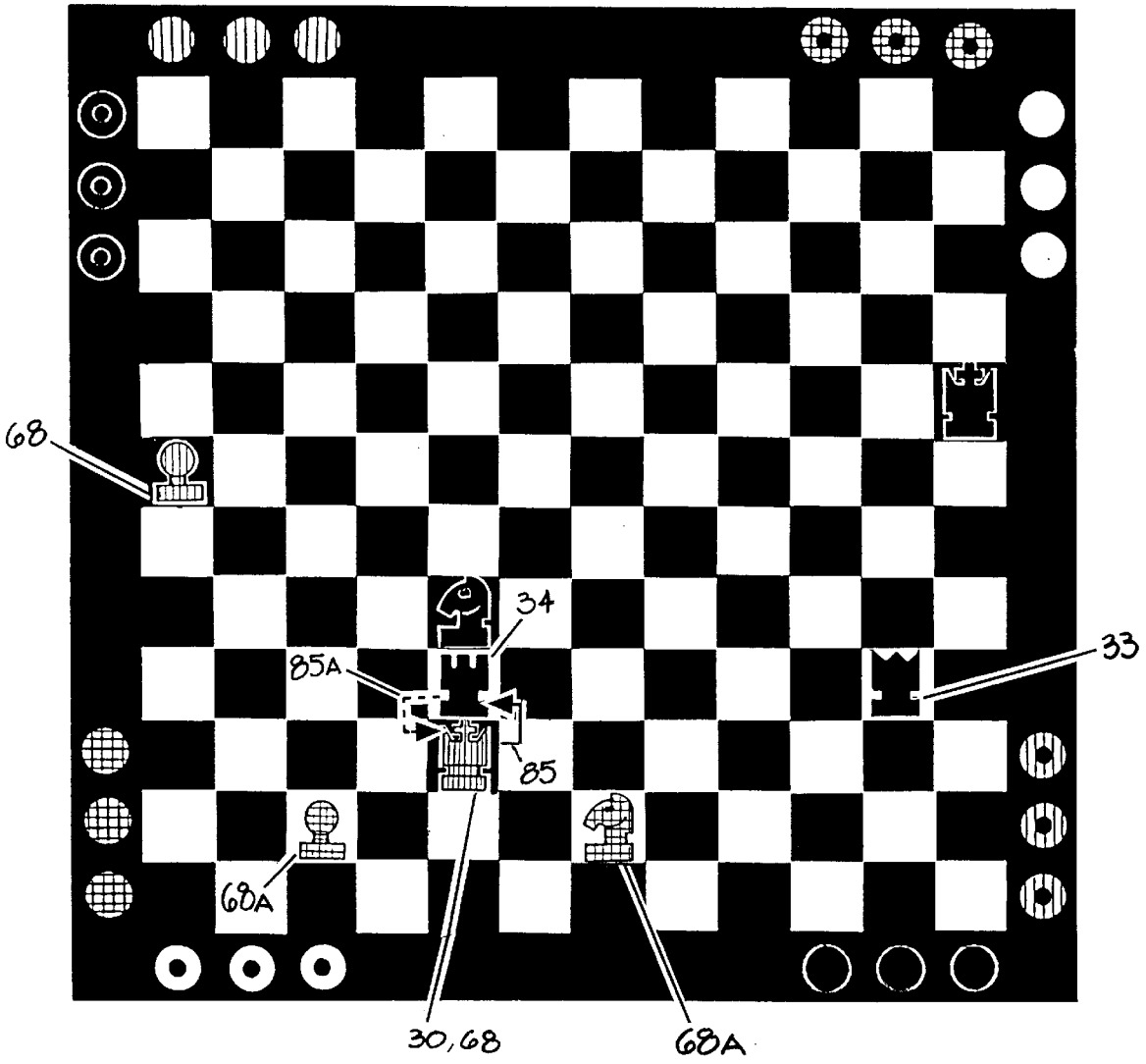
FIG. 21 is part of an example that illustrates a Great Army King moving into a check position when the position of check can be defended one of his divisions, prior to the opponents chronological turn to checkmate the Great Army King in check position.

As illustrated in FIG. 21, Red Army 42 is a Great Army 67 composed of Red Central Division 68 and a Yellow Division 68*a*. King 30 of Great Army 67 (Red King 30) is under check by Black Rook 34, as indicated by dashed arrow 85*a*. The chronological order to move in this example is: Red Central Division 68, Yellow Division 68*a*, and Black Army 41.

Red Central Division King 30 moves to capture Black Rook 34 (see FIG. 21, arrow 85). Red King 30 now exposes himself to check by Back Queen 33. Please see FIG. 22, dashed arrow 86*a*.

Figure 22:
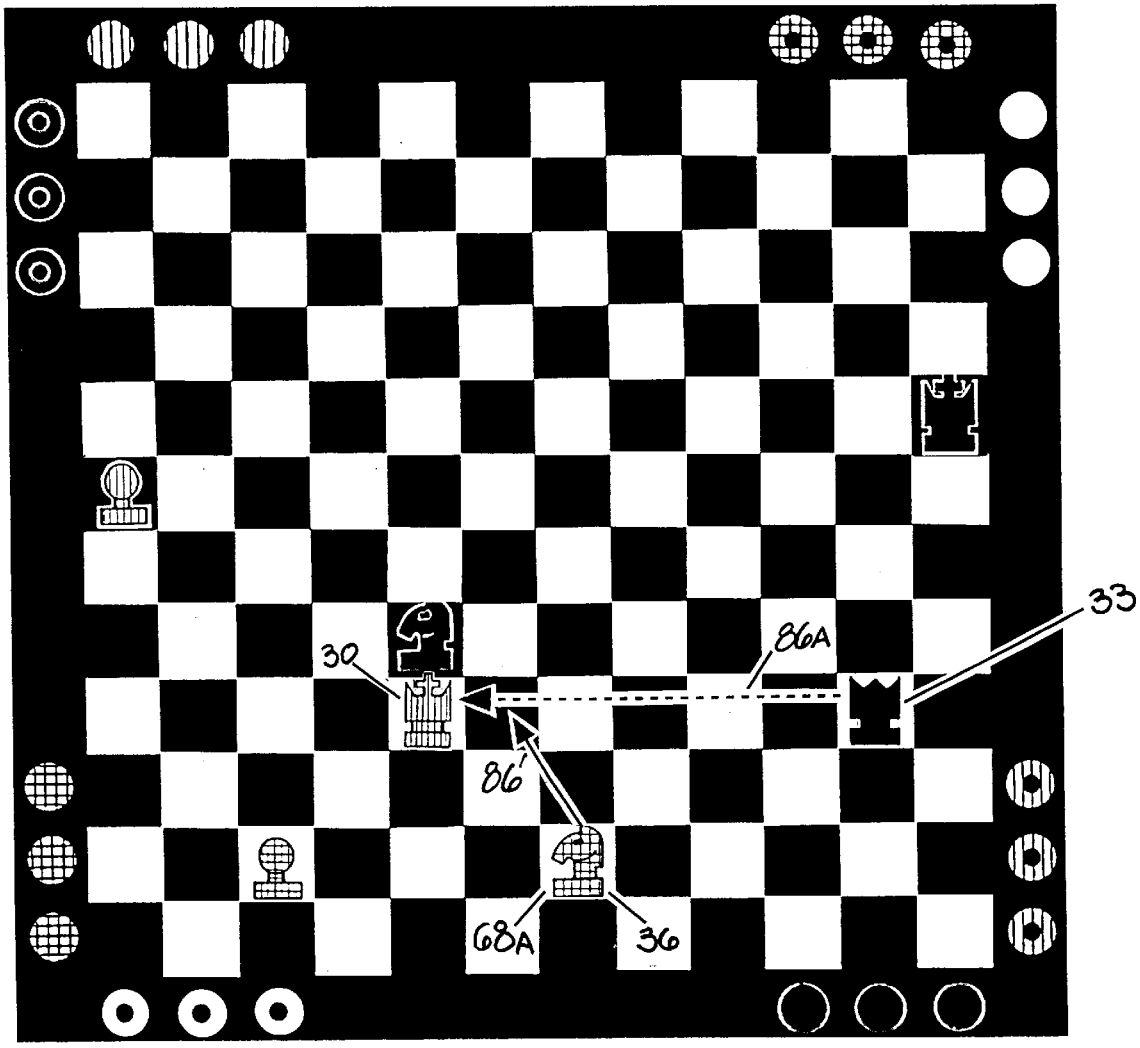
FIG. 22 is a continuation of the example on FIG. 21, but here with respect to the chronological turn and move of Yellow Division of the Great Army.
Figure 23:
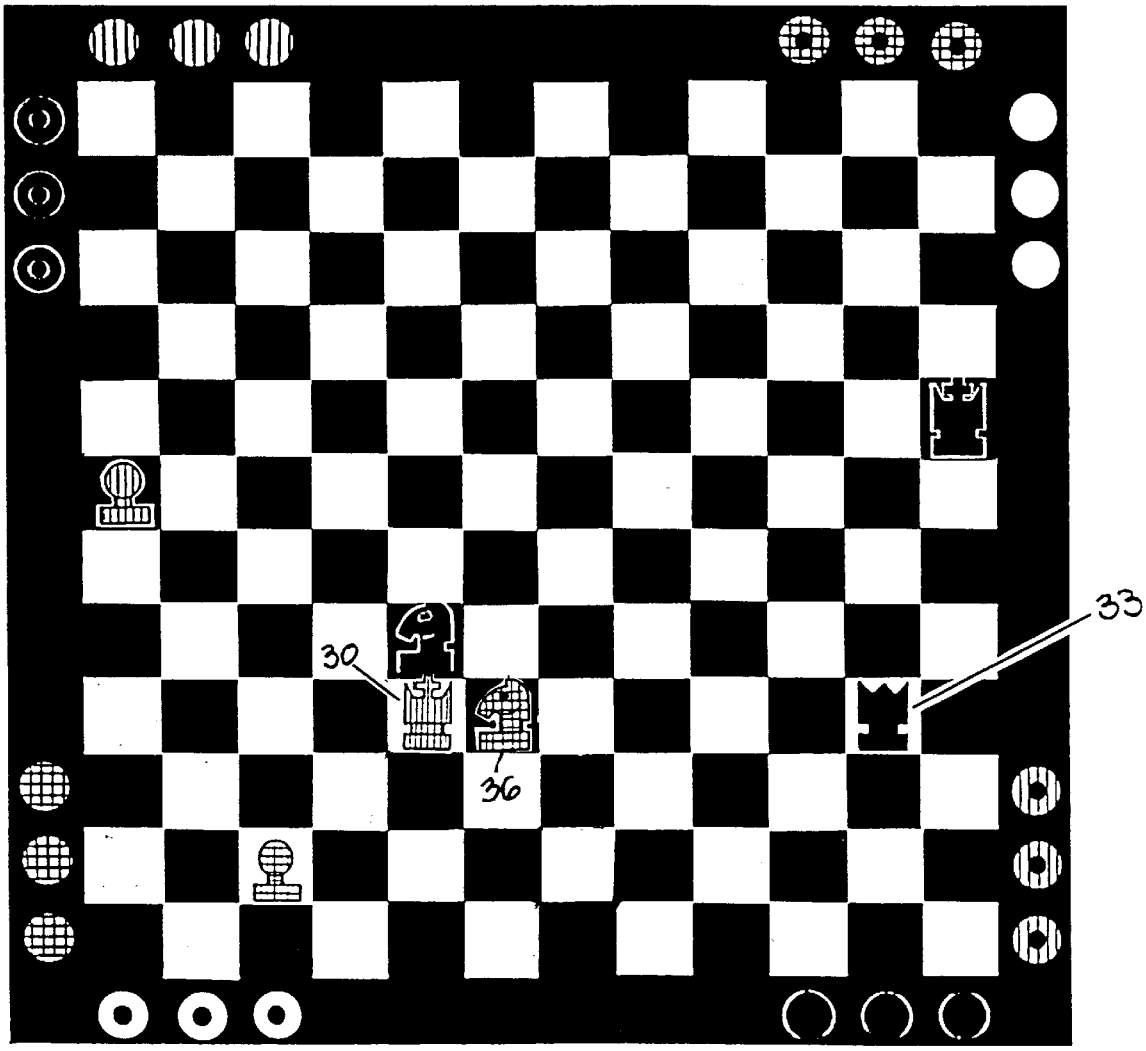
FIG. 23 is a continuation of the example of FIGS. 21 and 22, showing the conclusion of the example.

It is now Yellow Division 68's chronological turn to move along gameboard 3. As illustrated in FIG. 22, Yellow Knight 36 moves (as indicated by solid arrow 86) and blocks the path of Black Queen 33 by placing himself (Yellow Knight) between Red King 30 and Black Queen 33 (see dashed arrow 86a). Great Army 67 King 30 is saved from checkmate and removal from gameboard 3 by Black Queen 33, as seen in FIG. 23.

In sum, King 30 of a Great Army 67 can move into a check position if that position is: (i) defensible by a gamepiece 22 of a division 68*a* of that King 30's Great Army 67, and (ii) prior to an independent opposing gamepiece 22's next opportunity to checkmate Great King 30.

As show supra, the original concept of check in conventional chess is preserved in our invention 1 of a modified game of conventional chess. However, the threat of check leading inevitably to checkmate is diluted considerably by our novel methodology, number of armies, and chronological order of moving.

In conventional chess there are only two opponent armies from the beginning to the end of the game. Moreover, a King is only placed in check by a single opposing participant. The participant whose King is under check is notified of this situation by second opposing participant.

Figure 24:
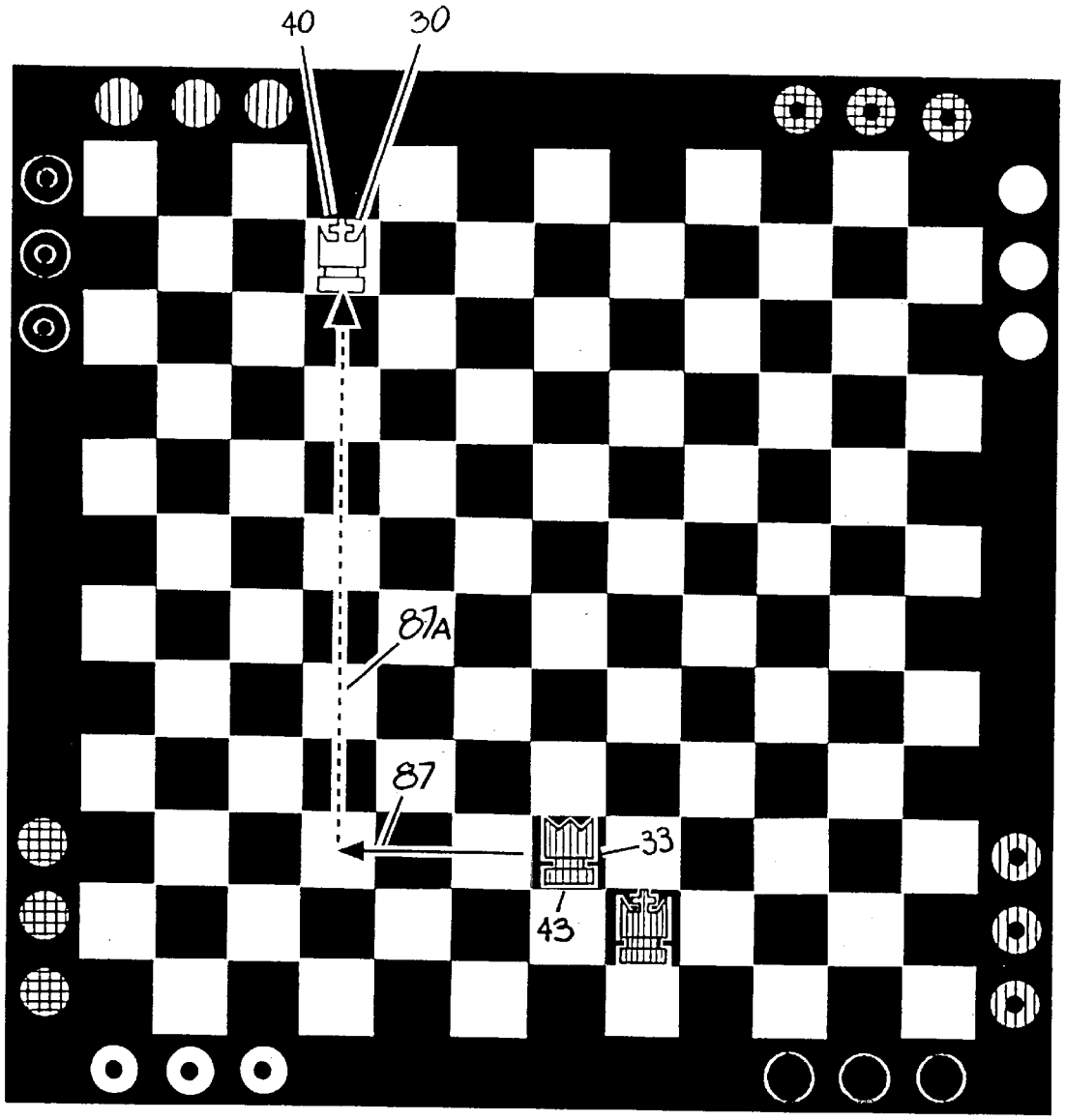
FIG. 24 is an example of direct notification of check.

Our invention 1 of a modified game of conventional chess illustrates what we refer to as direct check in FIG. 24. Direct check is defined as a move by an opposing gamepiece 22 to check a King 30. As seen in FIG. 24, Red 43 Queen 33 moves to check White King 30 as indicated by solid arrow 87. The check of White King 30 by Red Queen 33 after Red Queen 33's move to attack (check) White King 30 is indicated by dashed arrow 87*a*.

Figure 25:
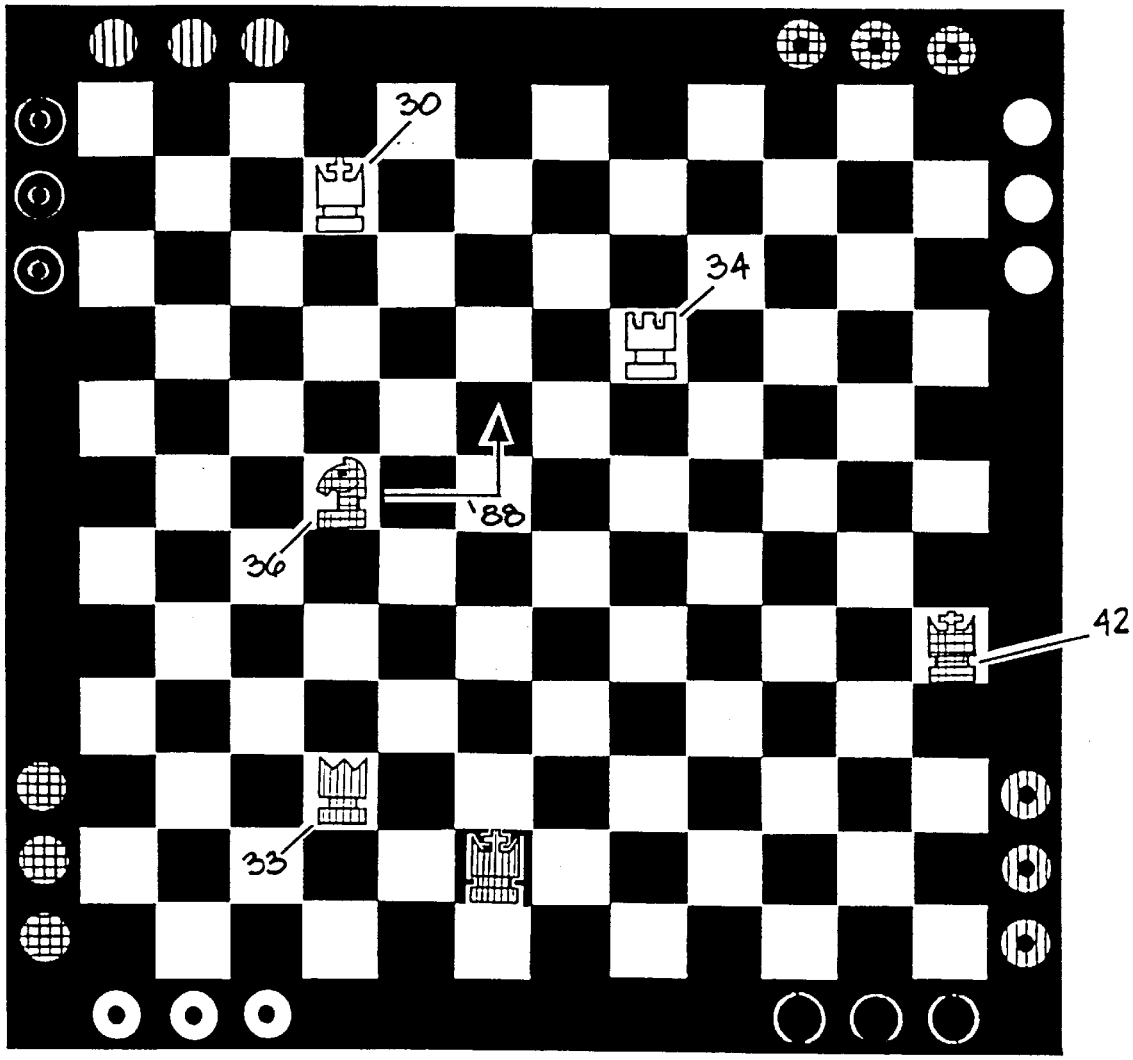
FIG. 25 is an example of indirect notification of check.

On the other hand an example of what is referred to as indirect check in our invention 1 of a modified game of conventional chess is illustrated in FIG. 25. Yellow Knight 36 moves against White Rook 34 as indicated by solid arrow 88. Yellow Knight move creates a check between White King 30 and Red Queen 33 (indicated by dashed arrow 88*a*).

Figure 26:
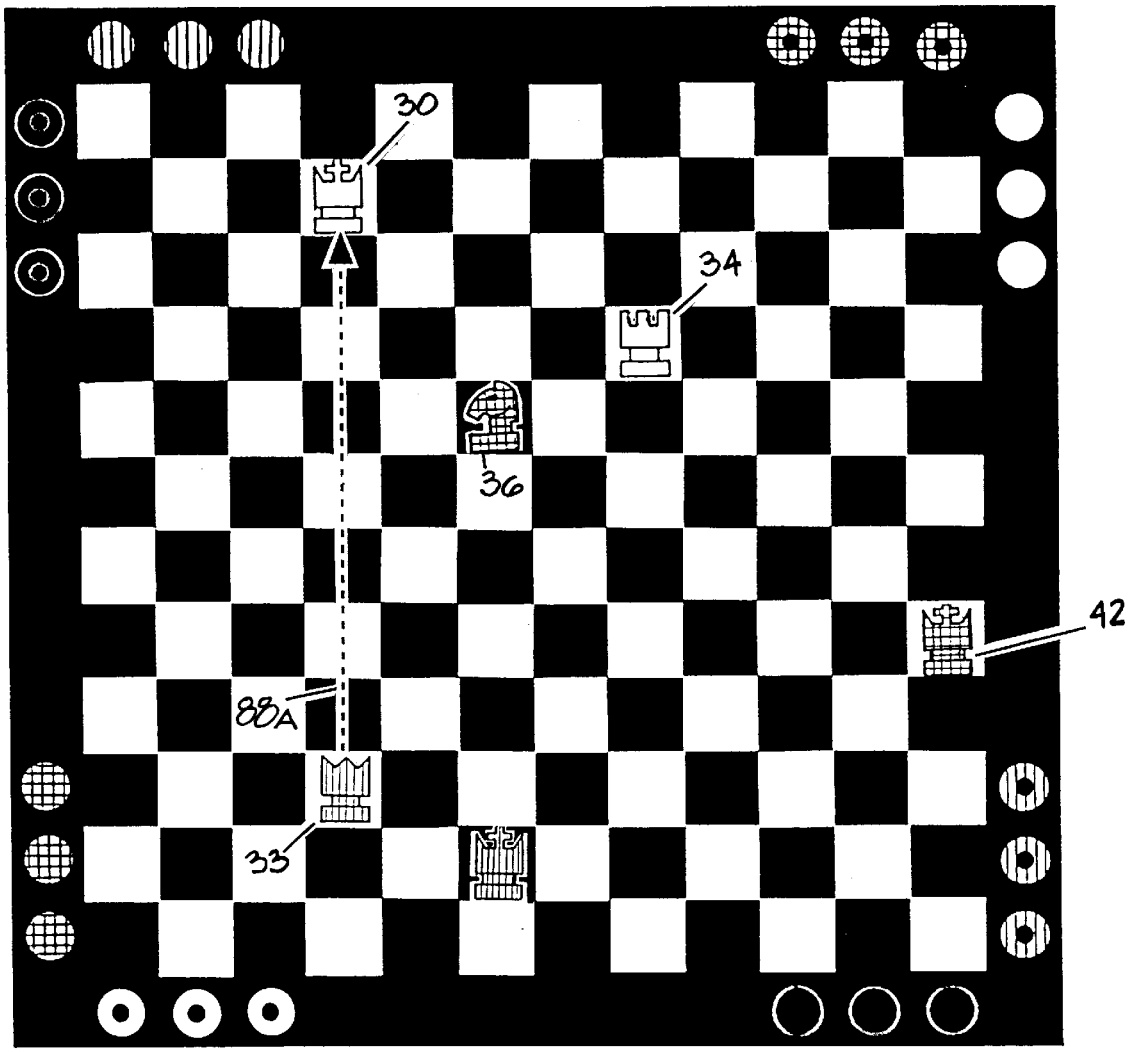
FIG. 26 is a continuation of the example of FIG. 25 and shows its conclusion of this particular example.

Please see FIG. 26. Consequently, indirect check occurs when a particular gamepiece 22 moves and clears a path for a second stationary gamepiece 22 of its own army or a different army to check a stationary opposing King 30.

In sum, in our invention 1 of a modified game of conventional chess, due to four opponent armies 17 initially on gameboard 3, check can occur as illustrated in FIGS. 24, 25 and 26 under two conditions: (i) the direct move of an opposing gamepiece 22 to place King 30 of an opposing army 17 under check; and (ii) the move of one gamepiece 22 which produces a state of check between two other completely different gamepieces 22 on gameboard 3,one of which is King 30.

As discussed supra, conventional chess defines the defeat of any army as placing the opponent's King in check from which that King cannot escape. Conventional chess defines the above situation as checkmate: Although the defeated King physically remains on the gameboard, the game is immediately over.

Our invention, however, defines the defeat, not as the move which places an opposing King in check from which the checked King cannot escape: Rather, the move which captures (removes from gameboard 3) King 30 is the critical last step. The expression "under checkmate" is a prior move by an opposing gamepiece 22 which places any remaining King 30 in check from which that checked King 30 cannot escape.

Our invention 1 of a modified game of conventional chess also defines defeat of an opponent army 17 as checkmate. However, the mechanics of our checkmate comprises both capture and physical removal of King 30 from gameboard 3. King 30 under checkmate in our invention 1 of a modified game of conventional chess loses its chronological opportunity to move upon gameboard 3. However, as seen in FIG. 27, army 17 associated with this checkmated King 30 remains undefeated, if that King 30 remains on gameboard 3 "under checkmate."

To defeat an army 17, King 30 of that army 17 must be captured and physically removed from gameboard 3 by an opposing gamepiece 22. This will take a minimum of two chronological turns (or moves); the first move places King 30 under direct or indirect check, from which the checked King 30 cannot escape. The second move of gamepiece 22 captures (removes from gameboard 3) the checked King 30.

Conditions under which a King 30 in our invention can move into a check position as discussed supra, with at least temporary immunity include: (i) the occurrence of check is by an allied piece 22 except for another King 30; (ii) when the check position involves an opposing gamepiece 22 whose own King 30 is in check by a third opposing army 17; and (iii) when a gamepiece 22 from a division 68*a*,68*b* of a Great Army 67 can defend the checked King 30.

Figure 27:
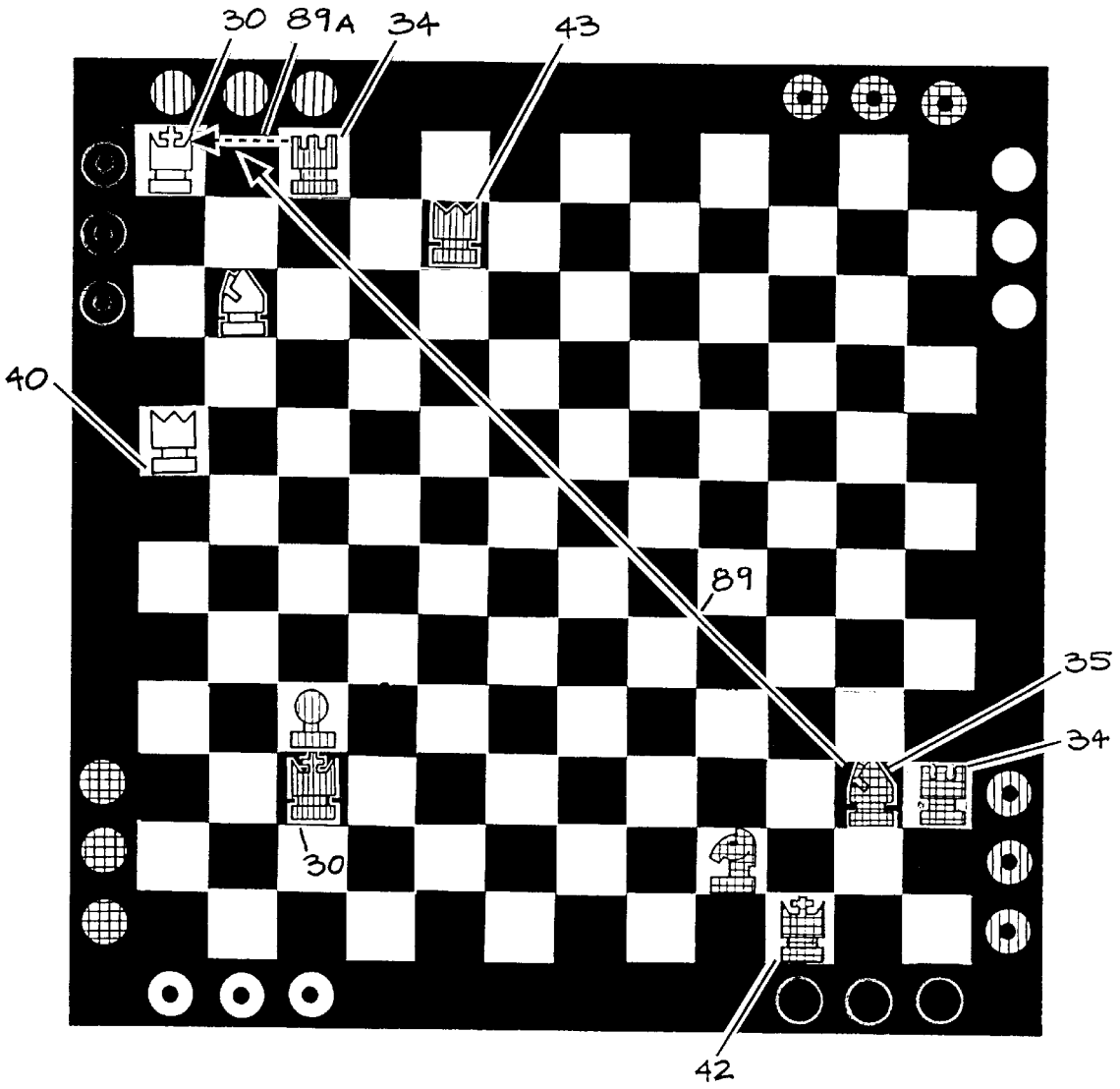
FIG. 27 is an example of modified "checkmate," and illustrates the chronological turn and move of Yellow Army.

As seen in FIG. 27 as an example of the above principles, Red Rook 34 initially checks White King 30. This scenario is indicated by a dashed arrow 89*a*. The chronological order of play for this example is: White 40 Army; Yellow Army 42; and Red Army 43. White King 30 now cannot move because it is under checkmate by Red Rook 34 and cannot escape. However, White Army 40 is not defeated as long as White King 30 remains on gameboard 3; White Army 40 simply loses its chronological turn to move.

Figure 28:
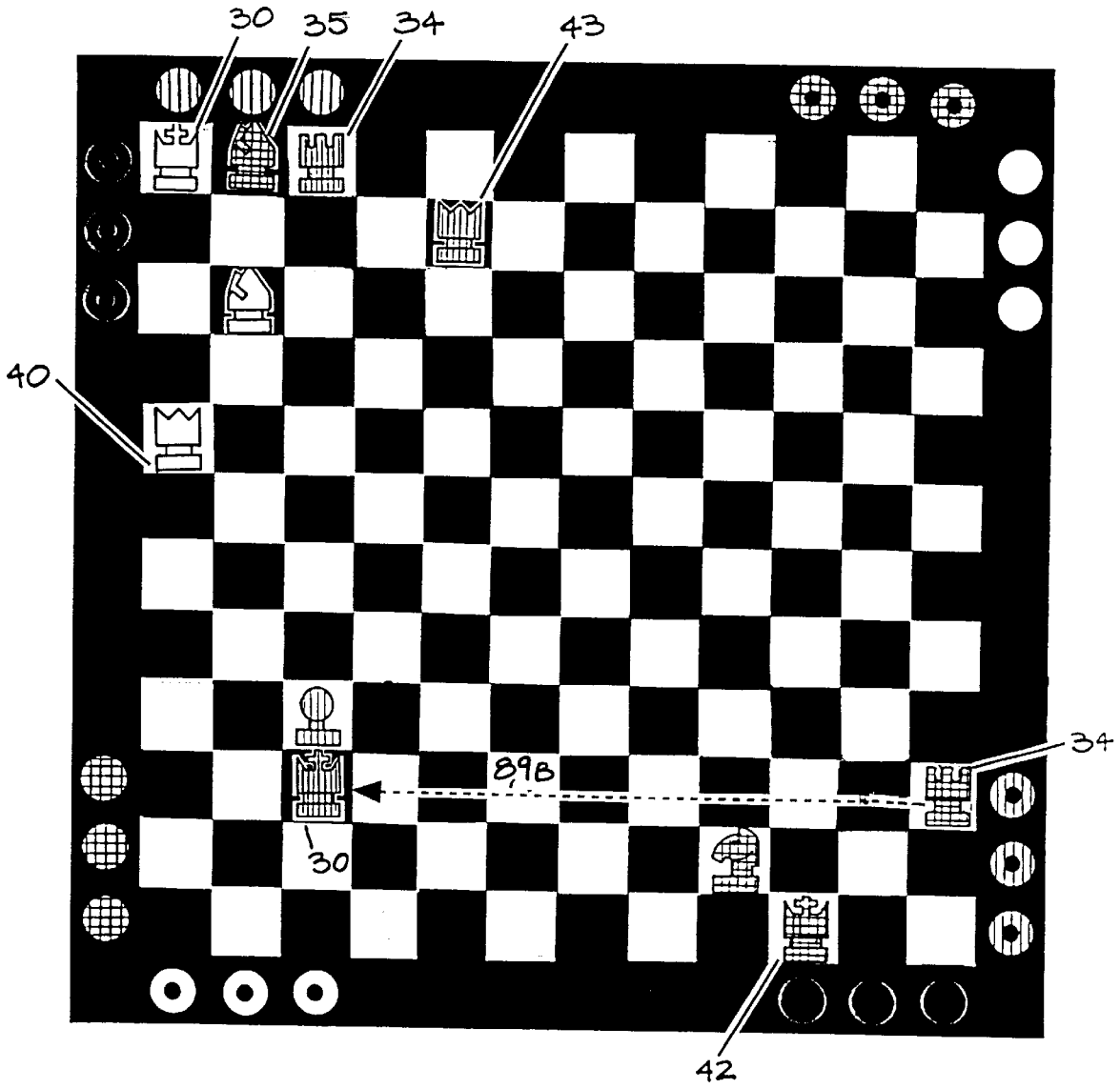
FIG. 28 is an illustrated continuation of the example of FIG. 27, and shows the conclusion of the example.

Yellow Army's Bishop 35 moves next as seen in FIG. 27. Yellow Bishop 35 moves between White King 30 and Red Rook 34. Yellow Bishop 35's move is indicated by solid arrow 89. Yellow Bishop 35's move prevents checkmate of White King 30. See FIG. 28. At the same time, Red King 30 is exposed to check by Yellow Rook 34, as indicated by dashed arrow 89*b* in FIG. 28. This is also another example of indirect check, because Yellow Bishop 35 clears a path for a second stationary gamepiece 22 (Yellow Rook 34), which can now check a stationary opposing Red King 30.

The rules governing "Notification of Check" (when King 30 is attacked and must be warned), are the same for our invention 1 as for conventional chess when an opposing gamepiece 22 creates the check between itself and an opponent King. This occurs when opposing gamepiece 22 moves, thereby creating check between itself and an opponent King 30.

In conclusion our invention's rules for "notification of check" also include situations in which:

(i) An opposing gamepiece 22 'moves' and creates check between itself and an opponent King 30; or (ii) an opposing gamepiece 22 'moves' and creates check between a a second stationary gamepiece 22 (of its own army 17 or a different army 17) and a stationary opposing King 30.

In both situations (i) and (ii), the participant 27 with the moving gamepiece 22 which creates the check condition is responsible for notification of this check.

Castling

In conventional chess the two gamepieces required for the maneuver known as castling, are a King and a Rook. In our invention 1 of a modified game of conventional chess, the two gamepieces 22 are King 30 and Bishop 35 from the same army 17 and whose gamepieces 22 are of the same color.

However, the actual movements are exactly the same as in conventional chess and are well known in the art. With castling King 30 moves into a safer position (generally away from a position which would eventually place King 30 in check).

In conventional chess and our invention 1 of a modified game of conventional chess, there are actually two moves, one for each of the two gamepieces 22, during one chronological turn of a participant's army 17. The King moves two squares across gameboard 3 as in conventional chess. However, the positions are different than in conventional chess, because King 30 is initially in a different position in conventional chess.

In general, King 30 cannot castle under the following conditions: into check; from check, or while in check positions. These conditions are exactly analogous to those of conventional chess. However, as previously shown and detailed above, there are checked positions in our invention, unlike conventional chess, which give at least temporary immunity for a King 30. Therefore, castling in our invention 1 of a modified game of conventional chess also be initiated from or into these checked positions. These conditions are: (i) the occurrence of check is by an allied piece 60 other than a King 30; (ii) when the checked position involves an opposing gamepiece 22 whose own King 30 is in check by a third opposing army 17; and (iii) when a gamepiece 22 from a division 68*a*,68*b* of a Great Army 67 can defend a checked Great Army King 30 prior to an opponent's chronological turn to capture Great King 30.

It is also important to remember that neither the Bishop 35 or King 30 must have moved previously during that particular game; it must be the first move for both gamepieces 22, in other words.

After castling is complete, in our invention Bishop 35 becomes vulnerable to attack instead of King 30. Castling in our invention occurs only when diagonal square 4 or 5 is unoccupied. Outlined below are two examples which illustrate castling in our invention. These are examples of what are known as horizontal castling and vertical castling respectively.

Figure 33:
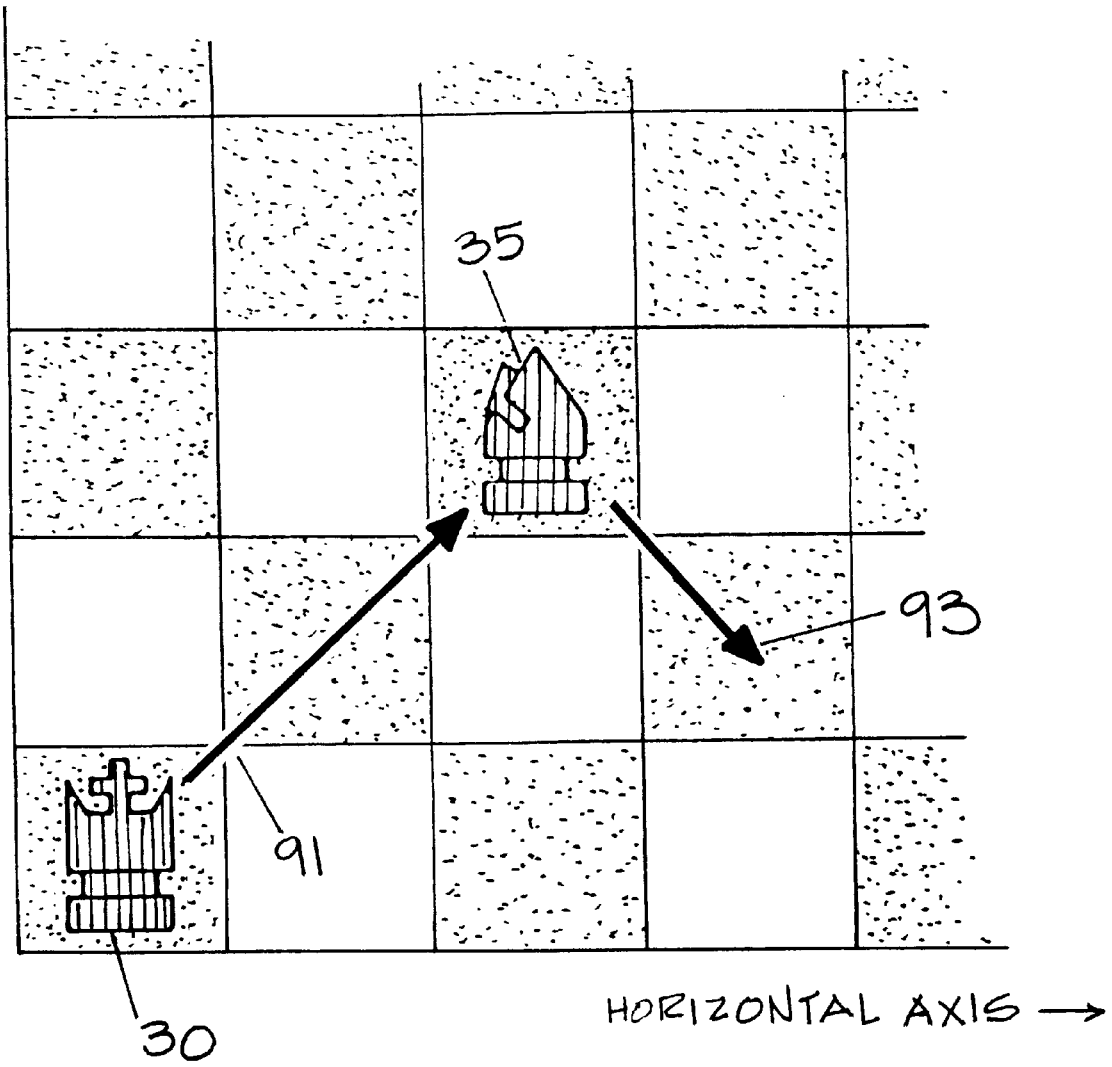
FIG. 33 is a view of the Red Army prior to horizontal castling.
Figure 34:
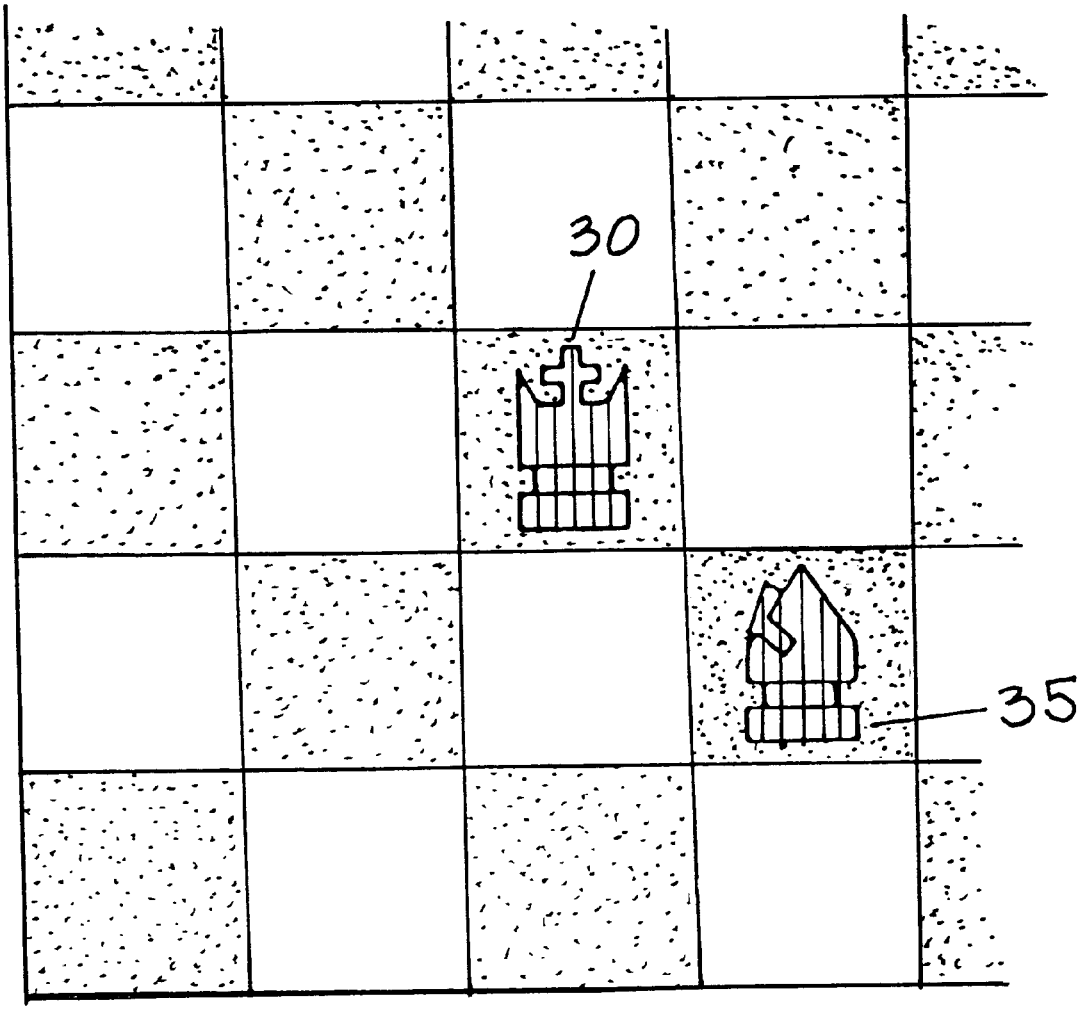
FIG. 34 is a view of the Red Army after castling along the horizontal axis.

FIG. 33 illustrates Red Army 43 prior to castling. The move by Red Bishop 35 is indicated by solid arrow 93. The second move by Red King 30 is indicated by solid arrow 91. The result is illustrated in FIG. 34, as Red Bishop 35 has moved one square 4,5 diagonally along the horizontal axis of its army 17. Meanwhile, Red King 30 has moved two squares 4,5, between the King 30 and Bishop diagonally to occupy the same square which previously was occupied by Red Bishop 35. These two movements along gameboard 3 during one chronological turn are known as horizontal castling.

Figure 35:
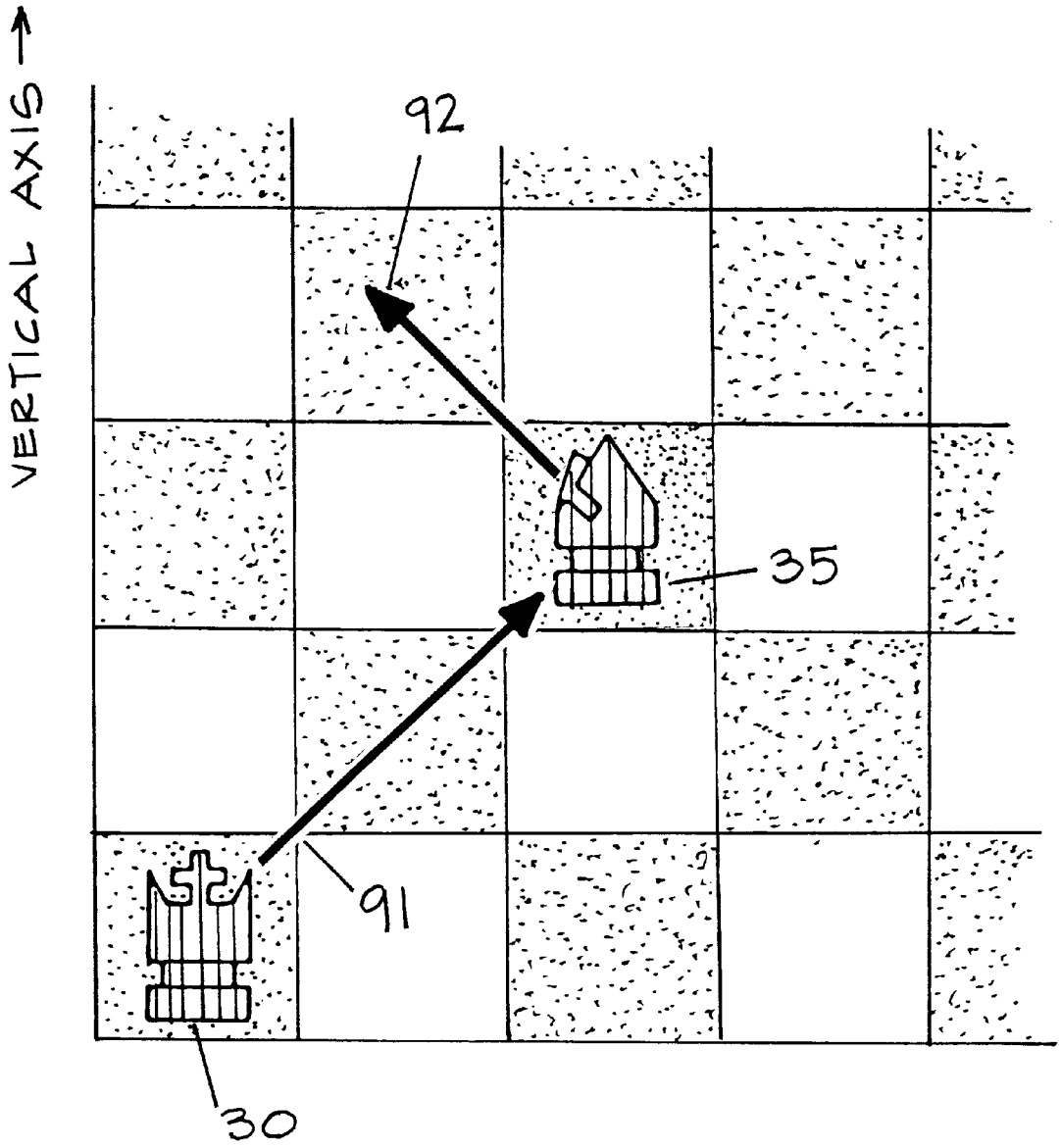
FIG. 35 is a view of Red Army prior to vertical castling.
Figure 36:
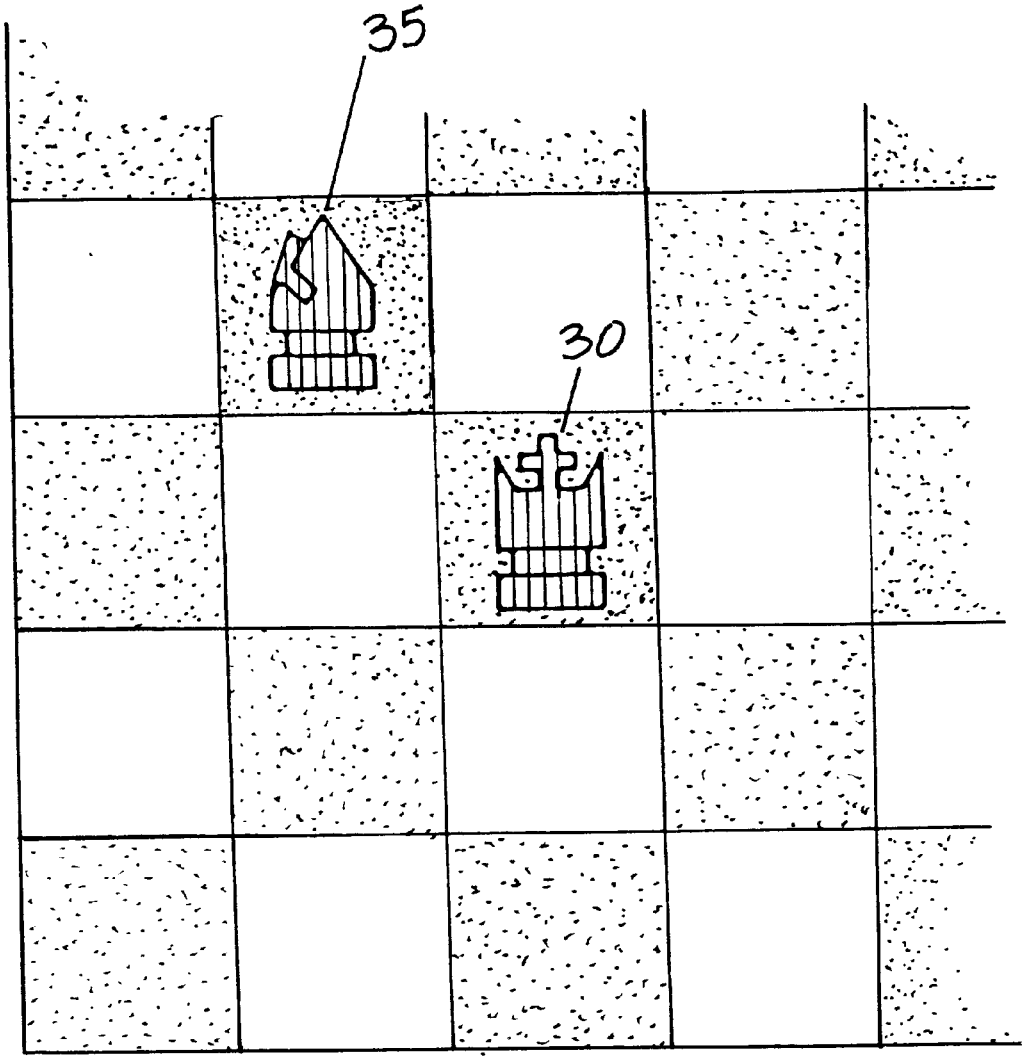
FIG. 36 is a view of the Red army after castling along the vertical axis.

FIG. 35 illustrates Red Army 17 prior to castling. The first move by Red Bishop 35 is indicated by solid arrow 92. The move by Red King 30 is indicated by solid arrow 91. The result appears in FIG. 36, wherein Red Bishop 35 has moved one square 4,5 along the vertical axis of Red Army 17. Red King 30 has moved two squares 4,5 diagonally to occupy the same square previously occupied by Red Bishop 35. Our invention 1 of a modified game of conventional chess defines this two gamepiece 22 maneuver as vertical castling.

The above examples of horizontal and vertical castling are applicable to all armies 17 and not merely Red Army 17. It applies to all embodiments as well, including the preferred embodiment.

Keeping Score with Our Invention

Keeping score with our novel game is as follows:

(i) when a single army 17 wins the game, that army 17 receives one point, and the other three participating armies 17 received zero points each.

(ii) When a game is a draw, and there are four armies remaining in the game, each army 17 receives ¼ point.

(iii) when the game is a draw, and there are three of the original four armies remaining in the game, each of three armies 17 receives ⅓ points and the fourth army (which is no longer in the game) receives zero points.

(iv) When the game is a draw and there are two of the original four armies 17 remaining in the game, each of the two armies receives ½ point. The other armies 17 (which are no longer in the game) receives zero points each.

The above description of the preferred embodiment and other embodiments is intended to be illustrative only. It is not in any way a limitation on the scope of my invention 1. Unless otherwise noted, conventional rules of chess apply where there is no specific mention of modification by our invention. Unless otherwise noted, our invention 1's rules apply to all embodiments of that invention.

What is claimed is:

1. A plurality participant/plurality army modified game of conventional chess wherein each said participant initially controls one said army, each participant controlling the gamepieces within said army, each said participant moving gamepieces of his/her army in chronological turns, said modified game comprising (a) a gameboard, said gameboard comprising (i) a square flat article with an, upper surface and a lower surface, said square flat article comprising seventy-two dark and seventy-two light colored equally sized smaller squares, said smaller squares alternating in a checkered pattern of twelve vertical and twelve horizontal rows;

(ii) a border, said border further comprising four 90 degrees corners, (iii.) designation marks in linearly arranged groups of three said designation marks, there being eight said linear groups of three said designation marks along said border, each said group of three designation marks being located adjacent to each said 90 degree angle corner, (iv.) each said designation mark comprising matching color or design within each group of three said designation marks, (b.) Four sets of gamepieces, each set comprising (i.) a color distinct from each said remaining set, each said set controlled initially by one said game participant, each said set comprising an army, (c) each said army initially comprising (i) one said gamepiece designated as King, (ii) one said gamepiece designated as Queen, (iii) two said gamepieces designated as Rooks, (iv) three said gamepieces designated as Bishops, (v) two said gamepieces designated as Knights, and (vi) seven said gamepieces designated as pawns, said pawns further comprising a first three said pawns with apertures, a second physically separate three pawns without apertures and one said remaining pawn comprising a spherelike protuberance (d) rules for playing a modified game of conventional chess said rules comprising (i.) alliance formation between said armies (ii.) dissolution of alliances between said armies (iii.) formation and operation of said Great Armies, each said Great Army comprising said armies of a checkmated King, said armies becoming divisions of said Great Armies after checkmate of said Kings, said army of said checkmated King becoming a division of said checkmating army, (iv.) diagrammatic directions for pawn movement upon said gameboard, said diagrammatic directions comprising said designation markers, (v.) directions for indirect and direct notification of checkmate (vi.) directions for castling between each said King and a said bishop within the same army;

(vii.) modified rules for checkmating comprising placing a King under check from which said King cannot escape, said subsequently checkmated King being physically removed from said gameboard by said opposing gamepiece during said next chronological move of said opposing gamepiece's participant.

2. The modified game of conventional chess of claim 1 wherein there are two said participants and four armies initially.

3. The modified game of conventional chess, as described in claim 1 wherein there are three participants and four armies initially and one said participant controls two independent armies, each with its own said chronological turn.

4. The modified game of conventional chess wherein said pawns of each said army are each initially located upon squares opposite said designation marks of color identical to that of said pawns or said designation markers of matching color further comprising concentric circles.

5. The modified game of conventional chess, as described in claim 1 wherein said gamepieces comprise a plurality of Great Armies.

* * * * *